US008849134B2

(12) United States Patent
Ogawa et al.

(10) Patent No.: US 8,849,134 B2
(45) Date of Patent: Sep. 30, 2014

(54) IMAGE FORMING APPARATUS HAVING BANDING CORRECTION FUNCTION

(75) Inventors: Yuichi Ogawa, Susono (JP); Takayuki Fukutani, Meridian, ID (US); Yuuji Takayama, Suntou-gun (JP); Tomoyuki Saiki, Suntou-gun (JP); Tae Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 416 days.

(21) Appl. No.: 13/117,363

(22) Filed: May 27, 2011

(65) Prior Publication Data

US 2011/0299861 A1 Dec. 8, 2011

(30) Foreign Application Priority Data

Jun. 7, 2010 (JP) ..... 2010-130286

(51) Int. Cl.

*G03G 15/02* (2006.01)
*G03G 15/01* (2006.01)
*G03G 15/00* (2006.01)

(52) U.S. Cl.

CPC ..... *G03G 15/5058* (2013.01); *G03G 15/0131* (2013.01); *G03G 2215/0164* (2013.01); *G03G 2215/00059* (2013.01); *G03G 2215/00063* (2013.01)

USPC ..... 399/31; 399/36; 399/49; 399/72; 358/1.9

(58) Field of Classification Search

USPC ..... 399/31, 36

See application file for complete search history.

(56) References Cited

U.S. PATENT DOCUMENTS

| | | | | |
|---|---|---|---|---|
| 5,673,067 | A | 9/1997 | Ogawa et al. | |
| 7,058,325 | B2 | 6/2006 | Hamby et al. | |
| 7,777,859 | B2 * | 8/2010 | Zolla et al. | 352/46 |
| 7,855,806 | B2 * | 12/2010 | Paul et al. | 358/1.9 |
| 7,911,652 | B2 * | 3/2011 | Goodman et al. | 358/3.26 |
| 8,373,902 | B2 * | 2/2013 | Takikawa et al. | 358/3.09 |
| 8,483,587 | B2 * | 7/2013 | Fukutani et al. | 399/49 |
| 8,619,336 | B2 * | 12/2013 | Tsutsumi et al. | 358/3.26 |
| 2004/0126125 | A1 * | 7/2004 | Yoda et al. | 399/45 |
| 2005/0196187 | A1 * | 9/2005 | Mizes et al. | 399/49 |
| 2005/0265739 | A1 * | 12/2005 | Hamby et al. | 399/49 |
| 2005/0265740 | A1 * | 12/2005 | Hamby et al. | 399/49 |
| 2005/0275855 | A1 * | 12/2005 | Mizes et al. | 358/1.9 |
| 2007/0139509 | A1 * | 6/2007 | Mizes et al. | 347/129 |
| 2008/0225905 | A1 | 9/2008 | Inagawa et al. | |
| 2010/0171970 | A1 | 7/2010 | Takayama et al. | |

(Continued)

FOREIGN PATENT DOCUMENTS

| | | |
|---|---|---|
| JP | 2005-338826 A | 12/2005 |
| JP | 2007-108246 | 4/2007 |
| JP | 2008-221847 A | 9/2008 |

*Primary Examiner* — David Gray
*Assistant Examiner* — Geoffrey Evans
(74) *Attorney, Agent, or Firm* — Fitzpatrick, Cella, Harper & Scinto

(57) ABSTRACT

The image forming apparatus includes a CPU that performs control to form an inspection image for determining whether or not banding is suppressed to be smaller than a predetermined threshold value; and a density sensor that detects an intensity of banding periodically occurring in a sub-scanning direction of the formed inspection image. If based the detected banding intensity, the CPU has determined that the banding is not suppressed to be smaller than the predetermined threshold value, the CPU performs control to not perform banding correction or performs control to re-set a relationship between a phase of a rotary member and correction information.

8 Claims, 20 Drawing Sheets

(56) References Cited

U.S. PATENT DOCUMENTS

| | | | | |
|---|---|---|---|---|
| 2010/0329712 | A1* | 12/2010 | Fukutani et al. | 399/49 |
| 2011/0052228 | A1* | 3/2011 | Kozitsky et al. | 399/49 |
| 2011/0076040 | A1* | 3/2011 | Uchidate et al. | 399/49 |
| 2011/0129020 | A1* | 6/2011 | Li et al. | 375/240.29 |
| 2011/0243582 | A1* | 10/2011 | Matsumoto et al. | 399/15 |
| 2011/0293304 | A1* | 12/2011 | Saiki | 399/49 |
| 2012/0148272 | A1* | 6/2012 | Ramesh et al. | 399/31 |
| 2012/0154826 | A1* | 6/2012 | Yamazaki | 358/1.1 |
| 2012/0250037 | A1* | 10/2012 | Ramesh et al. | 358/1.4 |
| 2013/0101301 | A1* | 4/2013 | Takikawa et al. | 399/10 |
| 2013/0120807 | A1* | 5/2013 | Takikawa et al. | 358/474 |
| 2013/0272728 | A1* | 10/2013 | Fukutani et al. | 399/36 |
| 2014/0055550 | A1* | 2/2014 | Keithley | 347/255 |

* cited by examiner

TIMING CHART OF INITIALIZING PROCESSING OF PHASE INFORMATION (FG SIGNAL)

EXPOSURE TIMING CHART OF TEST PATCH

FIG. 9A

W1

| FG SIGNAL (PHASE) | DENSITY VALUE |
|---|---|
| 0 | 10.000 |
| 1 | 10.098 |
| 2 | 10.191 |
| 3 | 10.278 |
| 4 | 10.354 |
| 5 | 10.416 |
| 6 | 10.462 |
| 7 | 10.490 |
| 8 | 10.500 |
| 9 | 10.490 |
| ⋮ | ⋮ |
| 30 | 9.809 |
| 31 | 9.902 |

(TABLE A)

CALCULATE DIFFERENCE CORRESPONDING TO AVERAGE DENSITY

| FG SIGNAL (PHASE) | DIFFERENCE (Δd1) |
|---|---|
| 0 | 0.000 |
| 1 | 0.098 |
| 2 | 0.191 |
| 3 | 0.278 |
| 4 | 0.354 |
| 5 | 0.416 |
| 6 | 0.462 |
| 7 | 0.490 |
| 8 | 0.500 |
| 9 | 0.490 |
| ⋮ | ⋮ |
| 30 | −0.191 |
| 31 | −0.098 |

(TABLE B)

FIG. 9B

W4

| FG SIGNAL (PHASE) | DENSITY VALUE |
|---|---|
| 0 | 10.000 |
| 1 | 10.141 |
| 2 | 10.200 |
| 3 | 10.141 |
| 4 | 10.000 |
| 5 | 9.859 |
| 6 | 9.800 |
| 7 | 9.859 |
| 8 | 10.000 |
| 9 | 10.141 |
| ⋮ | ⋮ |
| 30 | 9.800 |
| 31 | 9.859 |

(TABLE A)

CALCULATE DIFFERENCE CORRESPONDING TO AVERAGE DENSITY

| FG SIGNAL (PHASE) | DIFFERENCE (Δd2) |
|---|---|
| 0 | 0.000 |
| 1 | 0.141 |
| 2 | 0.200 |
| 3 | 0.141 |
| 4 | 0.000 |
| 5 | −0.141 |
| 6 | −0.200 |
| 7 | −0.141 |
| 8 | 0.000 |
| 9 | 0.141 |
| ⋮ | ⋮ |
| 30 | −0.200 |
| 31 | −0.141 |

(TABLE B)

FIG. 9C

| FG SIGNAL (PHASE) | SUMMED DIFFERENCE VALUES |
|---|---|
| 0 | 0.000 |
| 1 | 0.239 |
| 2 | 0.391 |
| 3 | 0.419 |
| 4 | 0.354 |
| 5 | 0.274 |
| 6 | 0.262 |
| 7 | 0.349 |
| 8 | 0.500 |
| 9 | 0.632 |
| ⋮ | ⋮ |
| 30 | −0.391 |
| 31 | −0.239 |

(TABLE C)

CALCULATE CORRECTION INFORMATION BY SUMMED DIFFERENCE VALUES

| FG SIGNAL (PHASE) | CORRECTION INFORMATION |
|---|---|
| 0 | 1.000 |
| 1 | 0.977 |
| 2 | 0.962 |
| 3 | 0.960 |
| 4 | 0.966 |
| 5 | 0.973 |
| 6 | 0.974 |
| 7 | 0.966 |
| 8 | 0.952 |
| 9 | 0.941 |
| ⋮ | ⋮ |
| 30 | 1.041 |
| 31 | 1.024 |

(TABLE D)

IMAGE FORMING APPARATUS HAVING BANDING CORRECTION FUNCTION

BACKGROUND OF THE INVENTION

1. Field of the Invention

The present invention relates to an image quality stabilization technology for an image forming apparatus.

2. Description of the Related Art

Electrophotographic or inkjet image-forming apparatuses have widely been used. These image forming apparatuses are required to provide images with a constant level of quality. As one of causes of image deterioration, density unevenness (hereinafter referred to as "banding") in a sheet conveyance direction (sub-scanning direction) can be considered. Under such circumstances, for example, Japanese Patent Application Laid-Open No. 2007-108246 proposes a solution to the banding in the sub-scanning direction. In Japanese Patent Application Laid-Open No. 2007-108246, first, banding in a sub-scanning direction occurring with a cycle corresponding to an outer diameter of a photosensitive drum is measured in advance in relation to phases of the photosensitive drum, and the measurement results are stored in a memory section as a density pattern information table. Then, when forming an image, banding information corresponding to the phases of the photosensitive drum is read out from the table, and based on the information, banding occurring with the cycle corresponding to the outer diameter of the photosensitive drum is corrected.

According to Japanese Patent Application Laid-Open No. 2007-108246, even though the mechanical precision is lowered, banding can be suppressed by means of electric image correction, so that costs required for the apparatus can be reduced.

Where, e.g., the temperature inside an image forming apparatus increases, a shaft and/or a drive gear in an electric motor may deform, resulting in variation in the amplitude and/or phase of rotation unevenness of each of such shaft and/or drive gear. Here, "Rotation unevenness" refers to periodic rotation speed variation. In such case, the technique of correcting image data such as in Japanese Patent Application Laid-Open No. 2007-108246 mentioned above has a problem in that a difference occurs between predicted banding and actually-occurred banding, resulting in an adverse increase in banding. The problem will be described in details below.

FIGS. 16A and 16B are diagrams each illustrating a relationship between predicted banding and actually-occurred banding. For example, it is assumed that densities of respective lines of a print image are predicted as indicated by predicted banding 2101 in FIG. 16A. Based on the predicted densities, the densities are corrected so as to cancel the banding. For example, for a scanning line with a high density in the predicted banding, like a scanning line L241, the image data is corrected so as to decrease the density, and meanwhile, for a scanning line with a low density in the predicted banding like a scanning line L242, image data is corrected so as to increase the density. Consequently, where there is almost no different in phase between the predicted banding 2101 and actually-occurred banding 2102 before correction as illustrated in FIG. 16A, the banding is cancelled so as to provide banding 2103 after correction, enabling suppression of banding. However, as illustrated in FIG. 16B, where there is a difference in phase between predicted banding 2104 and actually-occurred banding 2105 before correction, correction such as mentioned above results in an adverse increase in banding relative to the banding before correction. This will be described taking scanning lines L243 and L244 as an example. For a scanning line with a high density in the predicted banding like the scanning line L243, the corresponding image data is corrected so as to decrease the density. However, since a phase discrepancy occurs between the predicted banding and the actually-occurred banding, the actual density of the scanning line L243 is lower than an average density, and thus, the density is further decreased by the banding correction. Similarly, for a scanning line with a low density in the predicted banding like in the scanning line L244, because the actual density is higher than an average density, then the density is further increased by the banding correction. As a result, banding is adversely increased like banding 2106 by banding correction.

SUMMARY OF THE INVENTION

In order to solve the aforementioned problem, the purpose of the present invention is to provide a configuration described below.

Another purpose of the present invention is to provide an image forming apparatus including an image forming unit including a rotary member for image formation based on externally-input image data, the image forming apparatus including a correction section that performs banding correction for banding periodically occurring in a sub-scanning direction, by correcting the image data based on banding correction information according to a phase of the rotary member; a control section that performs control to make the image forming unit form an inspection image for determining whether or not an intensity of the banding periodically occurring in the sub-scanning direction is suppressed to be smaller than a predetermined threshold value, for an image formed by the image forming unit; and a detection section that detects the intensity of the periodic banding in the sub-scanning direction of the inspection image formed by the image forming unit, wherein if based on the intensity of the banding detected by the detection section, the control section has determined that the banding is not suppressed to be smaller than the predetermined threshold value, the control section performs control to not perform the banding correction or performs control to re-set a relationship between the phase of the rotary member and the banding correction information for correcting the image data.

A further purpose of the present invention will become apparent from the following description of exemplary embodiments with reference to the attached drawings.

BRIEF DESCRIPTION OF THE DRAWINGS

FIGS. 9A, 9B and 9C are tables used for exposure output correction for banding correction according to the embodiment.

DESCRIPTION OF THE EMBODIMENTS

Preferred embodiments of the present invention will now be described in detail in accordance with the accompanying drawings.

Hereinafter, an image forming apparatus that performs banding correction according to periodic rotation unevenness of a motor driving an image forming unit (correction of banding in a conveyance direction (sub-scanning direction) of a transfer material) will be described with reference to the drawings. However, the components described in the present embodiment are mere examples, and are not intended to limit the scope of the present invention to such components. The description is provided in the following sequence.

(1) First, a hardware configuration of the image forming apparatus will be described with reference to FIGS. 1A, 1B, 1C, 2A and 2E, and a description will be given with reference to hardware block diagrams in FIGS. 3A to 3C. Also, main functions will be described with reference to function blocks in FIGS. 5A and 5B.

(2) Next, using a flowchart for exposure output correction table creation processing in FIG. 6, processing for creating relationships (tables) between rotation unevenness of a motor as a rotary member utilized for image formation, and density correction information for correcting banding resulting from the rotation unevenness will be described. Here, rotation unevenness of a motor means periodic rotation speed variation of a motor. Hereinafter, such periodic rotation speed variation is referred to as "rotation unevenness". Furthermore, using the timing chart in FIGS. 7A to 7C, the exposure output correction table creation processing in FIG. 6 will be described in details.

(3) Then, a description will be described in terms of how to perform banding correction according to a periodic rotation unevenness of the motor using the density correction information (tables) for banding correction, which is held in the apparatus main body, during image formation (during exposure).

(4) Lastly, variations will be described.

Embodiment

[Cross-Sectional View of an Image Forming Apparatus]

Figure 1A:
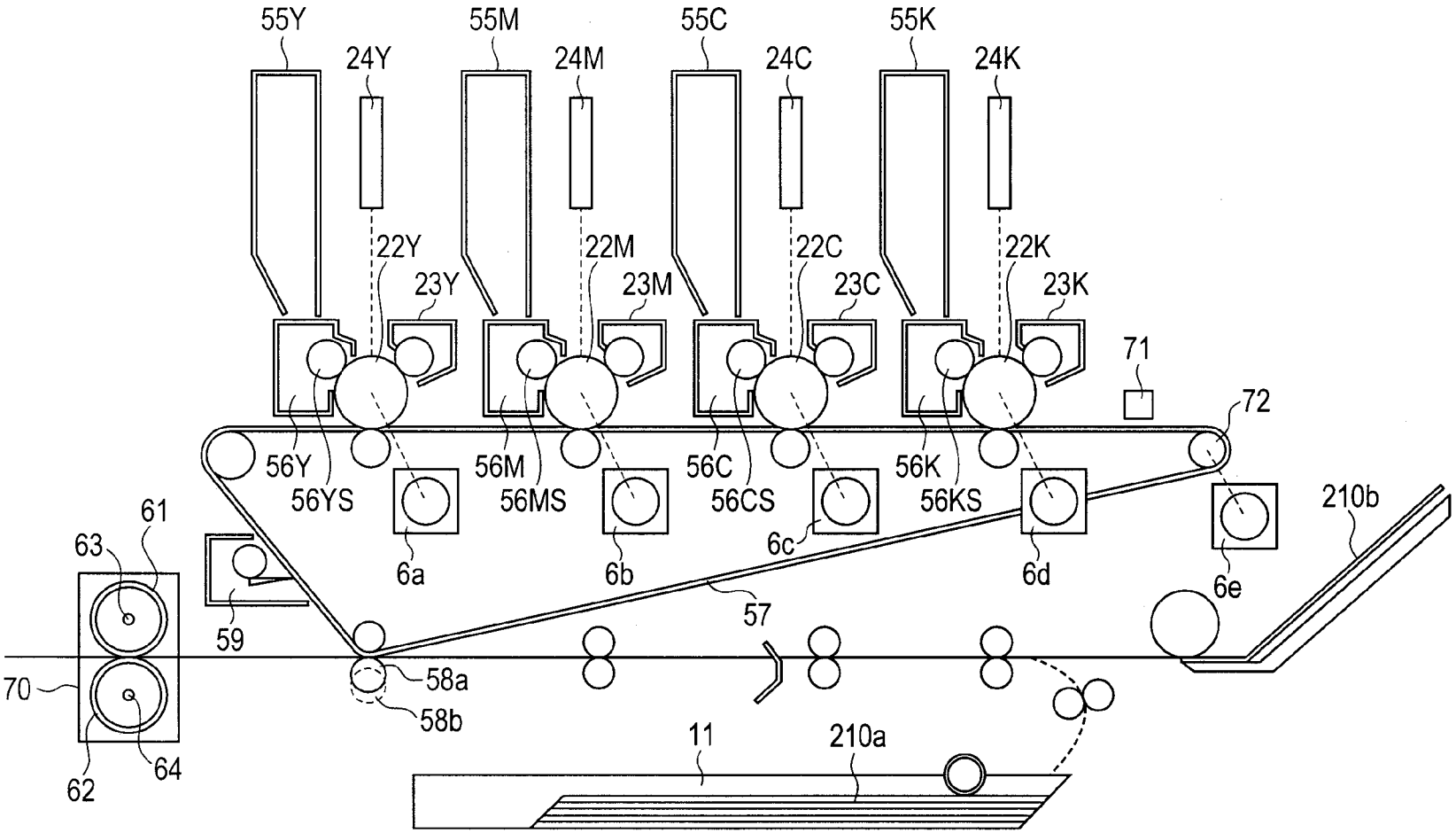
FIG. 1A illustrates a cross-section of an image forming apparatus according to an embodiment.
Figure 1B:
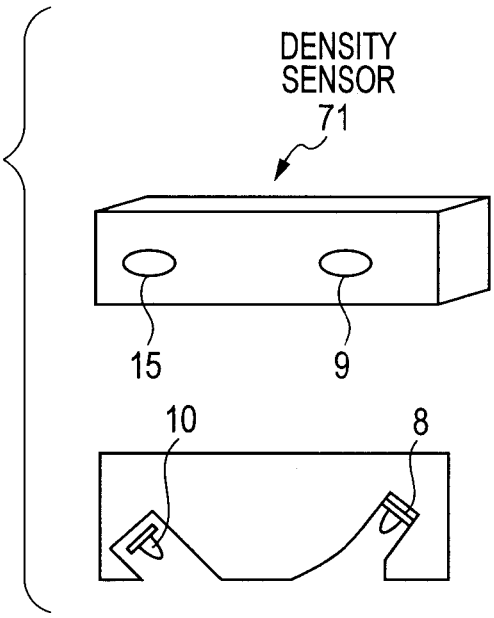
FIG. 1B illustrates a density sensor.
Figure 1C:
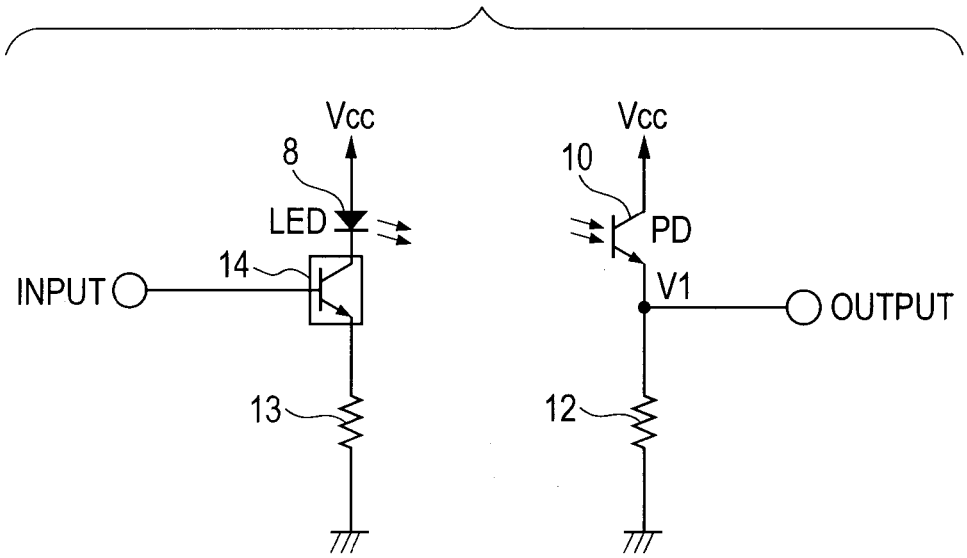
FIG. 1C illustrates a circuit in the density sensor.

FIGS. 1A to 1C is diagrams illustrating a color image forming apparatus according to an embodiment. In the color image forming apparatus, first, based on exposure light provided according to image information supplied from an image processing section (not illustrated in FIGS. 1A to 1C), an electrostatic latent image is formed, and the electrostatic latent image is developed to form a monochromatic toner image. Then, monochromatic toner images for respective colors are overlapped and transferred onto a transfer material 11, and the resulting polychromatic toner image on the transfer material 11 is fixed. A detailed description will be given below.

The transfer material 11 is fed from a sheet feed unit 210*a* or 210*b*. Photosensitive drums 22Y, 22M, 22C and 22K, which are each configured by providing an organic photoconductive (OPC) layer to an outer periphery of an aluminum cylinder, rotate upon receipt of driving forces from motors 6*a* to 6*d*. Here, Y, M, C and K correspond to yellow, magenta, cyan and black. Hereinafter, except where a separate description is provided for each color, indication of Y, M, C and K may be omitted. Chargers 23 charge the photosensitive drums 22. Each charger 23 includes a sleeve as illustrated in the cross-sectional view. Exposure light is provided from scanners 24, and makes surfaces of the photosensitive drums 22 be selectively exposed, thereby forming electrostatic latent images. Although each photosensitive drum 22 rotates with a certain eccentric component included therein, at the point of time when the electrostatic latent images are formed, a relationship in phase between the respective photosensitive drums 22 is previously adjusted so as to provide a same eccentric effect in a transfer unit. Developing devices 56 visualize the electrostatic latent images by means of toner supplied from toner cartridges 55. Each developing device 56 is provided with a sleeve 56YS, 56MS, 56CSa or 56KS (hereinafter, 56YS, 56MS, 56CS and/or 56K may simply be referred to as "56S"), and each developing device 56 is detachably attached to a main body of the image forming apparatus.

An intermediate transfer member 57 contacts the photosensitive drums 22, and rotates clockwise during color image formation, by means of a drive roller 72 driven by a motor 6*e*. The intermediate transfer member 57 rotates accompanying rotation of the photosensitive drums 22, thereby monochromatic toner images being transferred thereto. Subsequently, the intermediate transfer member 57 is brought into contact with a transfer roller 58 to pinch and convey the transfer material 11, and the resulting polychromatic toner image on the intermediate transfer member 57 is transferred onto the transfer material 11. During transfer of the polychromatic toner image onto the transfer material 11, the transfer roller 58 is contact with the transfer material 11 at a position 58*a*, and after the transfer, is spaced apart from the transfer material 11 at a position 58*b*. A fixing device 70 is provided to fuse and fix the polychromatic toner image transferred on the transfer material 11 while conveying the transfer material 11, and as illustrated in FIG. 1A, includes a fusing roller that heats the transfer material 11, and a pressure roller 62 that brings the transfer material 11 into pressure-contact with the fusing roller. The fusing roller 61 and the pressure roller 62 are hollow so as to include heaters 63 and 64 inside, respectively. In other words, the transfer material 11 holding the polychromatic toner image is conveyed by the fusing roller 61 and the pressure roller 62, and subjected to heat and pressure, thereby the toner being fused to the surface of the transfer material 11. The transfer material 11 after the toner image being fused thereto is subsequently output to an output tray by means of an output roller (not illustrated), and the image forming operation is terminated. A cleaning apparatus 59 is provided to clean toner remaining on the intermediate transfer member 57, and waste toner remaining after transfer of the four-color polychromatic toner image formed on the intermediate transfer member 57 onto the transfer material 11 is stored in a cleaner container. A density sensor 71 (also referred to as "optical characteristic detection sensor"), which is arranged so as to face the intermediate transfer member 57 in the image forming apparatus in FIG. 1A, measures a density of a toner patch formed on a surface of the intermediate transfer member 57.

Although the color image forming apparatus including the intermediate transfer member 57 is illustrated in FIG. 1A, the present invention is applicable also to an image forming apparatus employing a primary transfer method, in which toner images developed on photosensitive drums 22 are directly transferred onto a transfer material 11. In such case, the intermediate transfer member 57 should be replaced with a transfer material conveyance belt, which is a transfer material carrier, in the below description. Also, although in the cross-sectional view in FIG. 1A, the motors 6, which are drive units, are provided for the respective photosensitive drums 22, a plurality of the photosensitive drums 22 may share a motor 6. Also, for example, the conveyance direction of the transfer material 11 or the rotation direction of the intermediate transfer member 57 which are perpendicular to a main-scanning direction is referred to as a conveyance direction or a sub-scanning direction below.

[Configuration of the Density Sensor 71]

FIGS. 1B and 1C illustrate an embodiment of the density sensor 71, which is an optical characteristic detection sensor. As illustrated in FIG. 1B, the density sensor 71 includes an LED 8, which is a light-emitting element, and a phototransistor 10, which is a light-receiving element. Here, light applied from the LED 8 passes through a slit 9 for suppression of diffused light and reaches the surface of the intermediate transfer member 57. Then, the light reflected by the surface passes through an opening 15 for suppression of irregularly-reflected light, and then, regularly-reflected components of the light are received by the phototransistor 10. FIG. 1C is a diagram illustrating a circuit configuration of the density sensor 71. A resistance 12 is provided to divide a voltage of each of the phototransistor (PD) 10 and Vcc, and a resistance 13 limits a current for driving the LED 8. A transistor 14 turns the LED 8 on/off in response to a signal (Input) from a CPU 21 (FIGS. 3A and 3B). In the circuit illustrated in FIG. 1C, if an amount of regularly-reflected light from a toner image upon application of light from the LED 8 is large, a large current flows in the phototransistor 10, resulting in a voltage V1 detected as Output also having a large value. In other words, in the configuration in FIG. 1C, where the density of a toner patch is low, and thus, the amount of regularly-reflected light is large, a detection voltage V1 is high, and if the density of the toner patch is high, and thus, the amount of regularly-reflected light is small, the detection voltage V1 is low.

[Description of a Configuration of a Motor 6]

A configuration of a motor 6, which is a source of generation of banding to be corrected, will be described. First, a general configuration of a motor 6 will be described with reference to FIGS. 2A to 2D, and a mechanism of a periodic rotation unevenness occurring in the motor 6 will be described with reference to FIG. 2E.

[Description of General Configuration of a Motor]

Figure 2C:
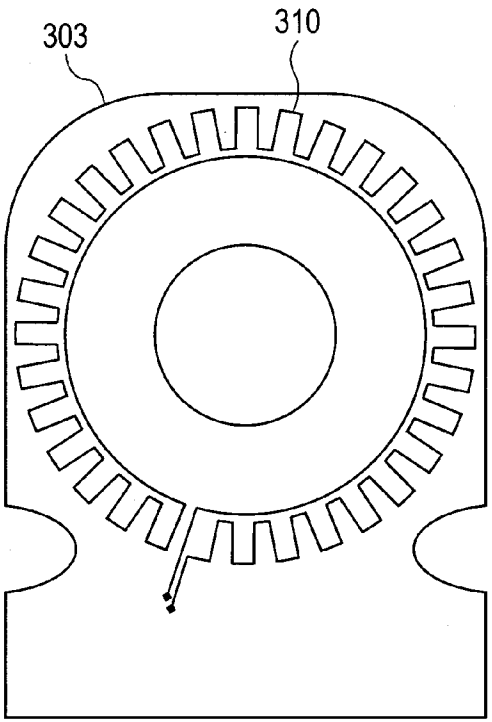
FIGS. 2A, 2B, 2C, 2D and 2E are diagrams illustrating a hardware configuration of a motor according to an embodiment.
Figure 2B:
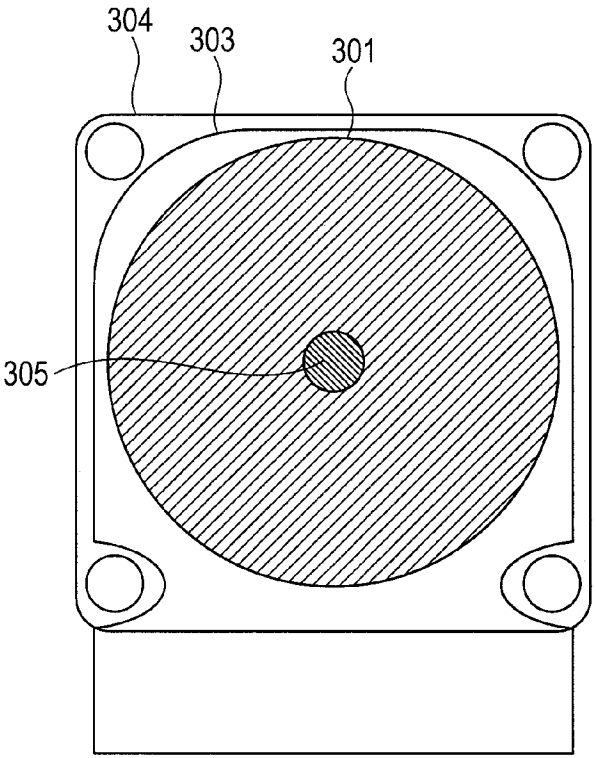
Figure 2A:
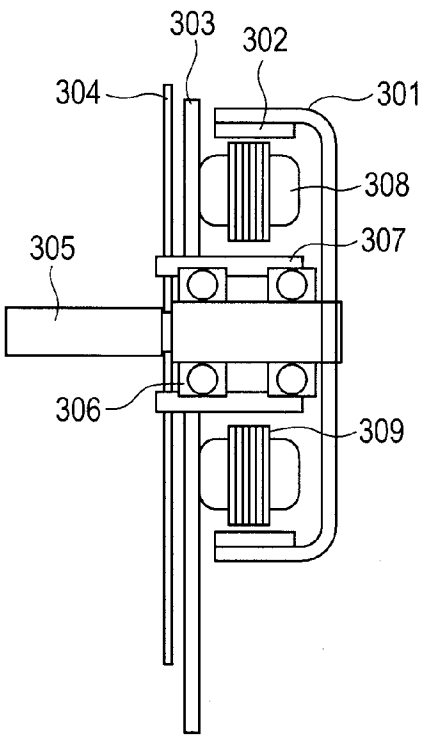

FIG. 2A illustrates a cross-sectional view of a motor 6, FIG. 2B illustrates a front view of the motor 6, and FIG. 2C illustrates a circuit board 303 extracted from the motor 6, respectively, as an example. The motor 6 may be any of various motors in the image forming unit such as, for example, the aforementioned motors 6*a* to 6*d* that drive the photosensitive drums 22, or the motor 6*e* that drives the drive roller 72.

In FIGS. 2A and 2B, a rotor magnet 302, which includes a permanent magnet, is attached to the inside of a rotor frame 301. A coil 309 is wound on a stator 308. A plurality of the stators 308 is arranged along an inner circumference of the rotor frame 301. A shaft 305 conveys a torque to the outside. More specifically, the shaft 305 is processed to form a gear or a gear including a resin such as POM is inserted into the shaft 305 to convey a torque to a corresponding gear. A housing 307 fixes a bearing 306 and is fitted in a plate 304. Meanwhile, on a surface on the rotor side of the circuit board illustrated in FIG. 2C, an FG pattern (speed detection pattern) 310 is printed in a circular shape so as to face an FG magnet 311. Furthermore, on the other side of the circuit board 303, circuit components for drive control, which are not illustrated, are mounted. The circuit components for drive control include, e.g., a control IC, a plurality of (for example, three) hall elements, a resistance, a capacitor, a diode and an MOSFET. Then, the non-illustrated control IC switches the direction of currents in the coils 309 based on the information on the position of the rotor magnet 302 (hall element output), and makes the rotor frame 301 and parts connected to the rotor frame 301 rotate.

Figure 2E:
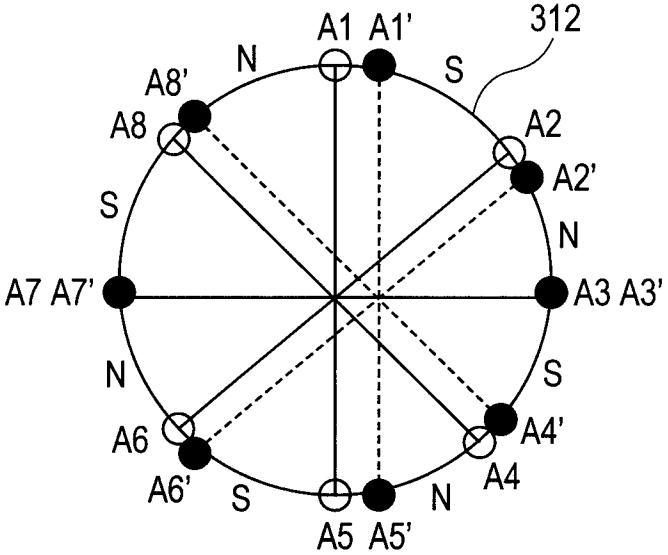
Figure 2D:
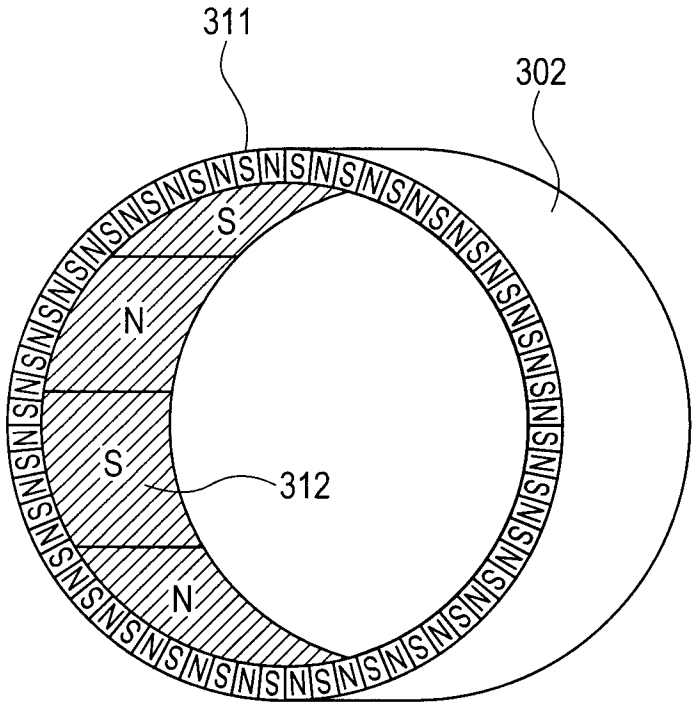

FIG. 2D illustrates the rotor magnet 30 extracted from the motor 6. Magnetization member 312 is provided on an inner circumferential surface of the rotor magnet 302, and magnetization member of the FG magnet 311 is provided on an open end surface of the rotor magnet 302. In the present embodiment, the rotor magnet 302 includes eight-pole (four N poles and four S poles) drive magnetization members. Furthermore, ideally the magnetization member 312 is magnetized alternately in N poles and S poles at equal intervals. Meanwhile, the number of magnetized N and S magnetic poles in the FG magnet 311 is larger than that in the drive magnetization members 312 (in the present embodiment, 32 pairs of N poles and S poles). The FG pattern 310 illustrated in FIG. 2C is formed by connecting a number of rectangular shapes in series in a ring shape, the number being the same as the number of poles in the magnetization of the FG magnet 311. The number of poles in the drive magnetization and the number of magnetic poles in the FG magnet are not limited to those in the above-described example, and other modes can be employed.

Here, the motor illustrated in FIGS. 2A to 2E employs a frequency generator (frequency generator) method in which a frequency signal proportional to a rotation speed is generated, that is, an FG method is employed for a speed sensor for the motor. The FG method will be described below. Upon the FG magnet 311 rotating integrally with the rotor frame 301, a sinusoidal signal having a frequency according to the speed of the rotation is induced in the FG pattern 310 as a result of change of magnetic flux relative to the FG magnet 311. The non-illustrated control IC generates a pulsed FG signal as a result of comparing the generated induced voltage and a predetermined threshold value. Then, based on the generated FG signal, the speed/drive control of the motor 6 and various processing, which will be described later, are performed. For the speed sensor for the motor 6, not only a frequency generator-type one, but also an MR sensor-type one or a slit plate-type encoder may be employed.

Although a detailed description will be given later, in the present embodiment, rotation unevenness of a motor 6 is linked with periodic banding. Thus, a rotation phase of rotation unevenness of the motor 6 is used as a parameter for predicting what periodic banding has been generated. Then, the CPU 21 identifies the rotation phase of the rotation unevenness based on the FG signal output from the motor 6 according to the rotation of the motor. For identifying a phase of rotation speed variation of a motor, any signal output at least once per rotation of the motor may be employed instead of the FG signal.

[Description of the Mechanism of Motor Rotation Unevenness]

In general, the state of rotation unevenness of the motor 6 for the cycle of one rotation depends on the structure of the motor 6. For example, the magnetization state of the rotor magnet 302 (magnetization variation for one rotation of the rotor) and a difference between the center positions of the rotor magnet 302 and the stators 308 determine the state of the rotation unevenness of the motor 6 for the cycle of one rotation. This is because these two factors make a comprehensive motor drive force generated by the entire stators 308 and the entire rotor magnet 302 changes during the cycle of one rotation of the motor 6. Here, magnetization variation will be described with reference to FIG. 2E. FIG. 2E is a diagram of the magnetization member 312 viewed from the front side. FIG. 2E illustrates boundaries A1 to A8 and A1' to A8' between the respective poles. FIG. 2E also illustrates boundaries A1 to A8 between N poles and S poles, which are plotted at equal intervals along the circumference where there is no magnetization variation. Meanwhile, the boundaries A1' to A8' each indicate a boundary between an N pole and an S pole where there is magnetization variation.

Also, the eccentricity of the shaft 305 (pinion gear) can be considered as a factor of the rotation unevenness of the motor 6. The rotation unevenness is conveyed to the counterpart to be rotated, which appears in the form of banding. Although the eccentricity of the shaft 305 (pinion gear) also has a cycle identical to the cycle of one rotation of the motor 6, the rotation unevenness resulting from combination of the rotation unevenness and the previously described rotation unevenness occurring due to magnetization variation is conveyed to the drive force conveyance destination and appears in the form of banding. The above is a representative mechanism of rotation unevenness in the cycle of one rotation of a motor.

Meanwhile, in the motor 6, rotation unevenness with the cycle other than the aforementioned one rotation period is occurred. In the case of a motor having drive magnetic poles provided by eight-pole magnetization being provided to the rotor magnet 302, since the motor includes four sets of an N pole and an S pole, change in magnetic flux for four cycles is detected from the non-illustrated hall elements for one rotation of the motor. Then, if the arrangement of any of the hall elements is deviated from an ideal one, the positional relationship between outputs from the respective hall elements fall apart in change in magnetic flux for one cycle. Then, in the motor drive control in which excitation of the coils 309 wounded on the stators 308 is switched based on the outputs from the respective hall elements, the switching falls off the timing. As a result, rotation unevenness for the cycle of one-fourth of the cycle of one rotation of the motor 6 occurs four times while the motor 6 makes one rotation. Although the rotor magnet 302 in the present embodiment is configured to has eight-pole drive magnetization, in the case of a rotor magnet 302 having drive magnetization with a different number of magnetic poles, rotation unevenness with the cycle of an integer/integers of the cycle of one rotation (i.e., with a frequency multiplied by the integer/integers), the integer depending on the number of magnetic poles in the drive magnetization, occurs.

[Block Diagram of Entire Hardware]

Figure 3A:
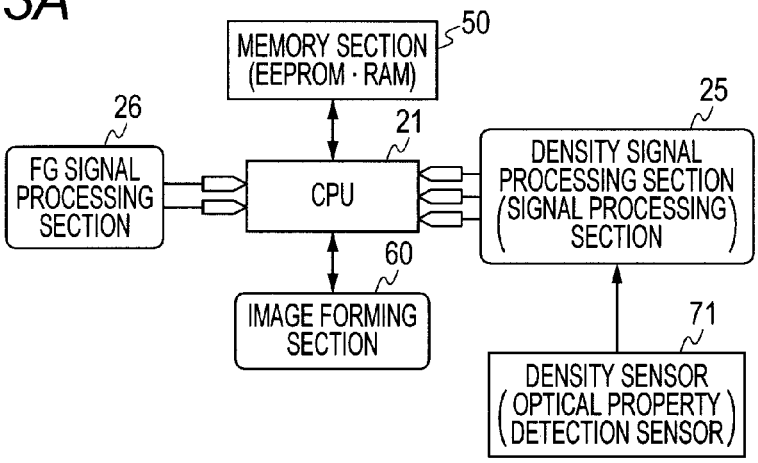
FIG. 3A is a block diagram illustrating an overall configuration of the apparatus according to the embodiment.

FIG. 3A is a general block diagram of a main hardware configuration in the present embodiment. Here, each of a density signal processing section 25 (hereinafter referred to "signal processing section 25") and an FG signal processing section 26 includes, for example, an application-specific integrated circuit (ASIC) or an system-on-chip (SOC). The CPU 21 performs various types of control in cooperation with respective blocks such as a memory section 50, an image forming unit 60, the FG signal processing section 26, the signal processing section 25 and the density sensor 71. The CPU 21 also performs various types of calculation processing based on input information. The memory section 50 includes an EEPROM and a RAM. The EEPROM stores a relationship between a count value for identifying an FG signal as phase information for a motor 6 (corresponding to phase information for a motor) and correction information for image density correction in such a manner that the relationship can be rewritten. The EEPROM also stores various types of other setting information for the CPU 21's image formation control. The RAM in the memory section 50 is used for temporarily storing information for the CPU 21 to perform various types of processing. The image forming unit 60 is a collective term for the components relating to image formation, which have been described with reference to FIG. 1A, and a detailed description of the image forming unit 60 will be omitted here. Also, the density sensor 71 (optical characteristic detection sensor) has also been described with reference to FIGS. 1B and 1C.

The signal processing section 25 receives an input of a detection result signal from the density sensor 71 and outputs the input signal to the CPU 21 with the input signal unprocessed or processed so that the CPU 21 can easily extract banding related to the motor 6. Meanwhile, the FG signal processing section 26 receives an input of an FG signal output from the motor 6, which has been described with reference to FIGS. 2A to 2E, and performs processing for the FG signal. For example, the FG signal processing section 26 processes the FG signal and outputs the FG signal to the CPU 21 in order for the CPU 21 to identify the phase of the motor 6, or notify the CPU 21 of a result of determination in the processing for the FG signal.

In the general block diagram, the CPU 21 creates a table in which the rotational phase of the motor 6 and correction information for density correction (banding correction) are related to each other, based on the density signal output from the signal processing section 25 and the phase signal output from the FG signal processing section 26. Also, the CPU 21 makes the scanner 24 perform exposure with density correction reflected therein. The density correction is synchronized with the change of the phase of the motor 6, which has been identified based on the FG signal supplied from the FG signal processing section 26, to correspond to the phase of rotation unevenness of the motor 6. The details of such exposure will be described later with reference to, e.g., a flowchart.

<Detailed Block Diagram of the Signal Processing Section 25>

Next, the details of the signal processing section 25 described with reference to FIG. 3A will be described with reference to FIG. 3B. A low-pass filter (hereinafter referred to as "LPF") 27 allows selective passage of signals with particular frequency components. The cutoff frequency settings for the filter are made such that the filter mainly allows passage of signals with a frequency component having no more than one cycle during one rotation of the motor 6 (hereinafter referred to as "W1 component") and attenuates other signals with a frequency resulting from the W1 component being multiplied by an integer. FIG. 4A illustrates an example of operation of the LPF 27. As a result of making a density sensor output pass through the LPF 27, sensor output data A is output to the CPU 21, enabling easy extraction of banding of the W1 component. Furthermore, a band-pass filter (hereinafter referred to as "BPF") 28 can extract predetermined frequency components from an output from the density sensor 71. In the present embodiment, a configuration in which rotation unevenness having a frequency that is four times the frequency of rotation of the motor (i.e., the cycle that is one-fourth of the frequency of the motor: hereinafter referred to as "W4 component) is extracted is provided as an example. For the characteristics of the filter, two cutoff frequencies are provided with the frequency of the W4 component as the center. FIG. 4B illustrates an example operation of the BPF 28. As a result of making a density sensor output pass through the BPF 28, sensor output data B is output to the CPU 21, enabling easy extraction of banding of the W4 component. Furthermore, the signal processing section 25 also outputs raw sensor output data in which the components of the rotation unevenness of the motor 6 have not been removed from the detection result of the density sensor 71 to the CPU 21. The raw sensor output data is used, for example, when the CPU 21 calculates an average value for detection values of the density sensor 71.

Although described in details later, the CPU 21 calculates correction values for correcting both the banding of the W1 components and unevenness of the W4 components, which have been derived from the rotation unevenness of the motor 6. The calculated correction values are related to a count value of the FG signal and stored in the memory section 50. During image formation (exposure), the calculated correction values are used according to the phase of the rotation unevenness of the motor 6. Here, the phase of the rotation unevenness of the motor 6 is related to a certain state in periodic rotation speed variation of the motor 6. Change of the phase of the rotation unevenness of the motor 6 refers to change of the speed of the motor 6 from a certain previous speed state.

<Detailed Block Diagram of the FG Signal Processing Section 26>

Next, the details of the FG signal processing section 26 described with reference to FIG. 3A will be described with reference to FIG. 3C. An F/V converter 29 performs analysis of the frequency of an obtained FG signal. More specifically, the F/V converter 29 measures the pulse cycle of the FG signal, and outputs a voltage according to the cycle. Cutoff frequencies for a low-pass filter 30 (hereinafter, "LPF 30") are set so that the filter allows passage of components with frequencies equal or smaller than the frequency of the W1 component and attenuates signals with frequencies larger than the frequency of the W1 component. Instead of the F/V converter 29 and the low-pass filter 30, an FFT analysis section may be provided to analyze the frequency of the FG signal. A switch SW31 provides switching of whether or not a signal output from the LPF 30 is input to a determination section 32. An SW control section 33 turns the switch SW31 on by means of an initializing signal, and turns the switch SW31 off by means of an FG count signal input first after the end of a reset. The determination section 32 obtains the signal input from the LPF 30 for one rotation of the motor and calculates an average value for the signal. After calculation of the average value, a value input from the LPF 30 and the average value are compared, and if the result of the comparison falls under a predetermined condition, a counter reset signal is output. The counter reset signal is input to the SW control section 33 and an FG counter 34. Furthermore, the counter reset signal is sent to the CPU 21, and the CPU 21 is thereby notified of the reset being made. The FG counter 34 counts up the number of FG pulses for one rotation of the motor and is toggled. In the present embodiment, when the motor 6 makes a rotation, an FG signal with 32 pulses is output, and thus, the FG counter 34 counts 0 to 31, and outputs the count value to the CPU 21. Furthermore, upon receipt of the counter reset signal, the FG counter 34 resets the count to "0".

[Hardware Configuration and Function Block Diagrams]

Figure 3B:
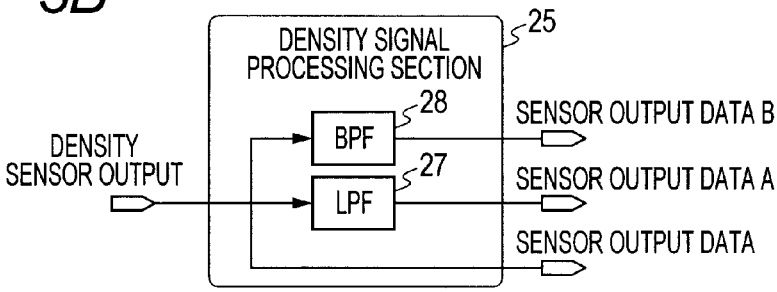
FIG. 3B is a block diagram of a density signal processing section.
Figure 3C:
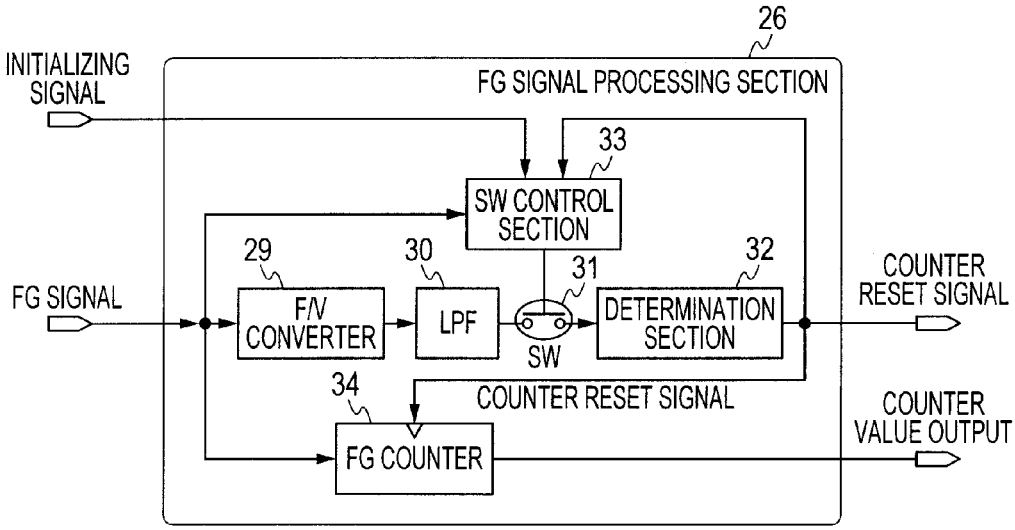
FIG. 3C is a block diagram of an FG signal processing section.
Figure 4A:
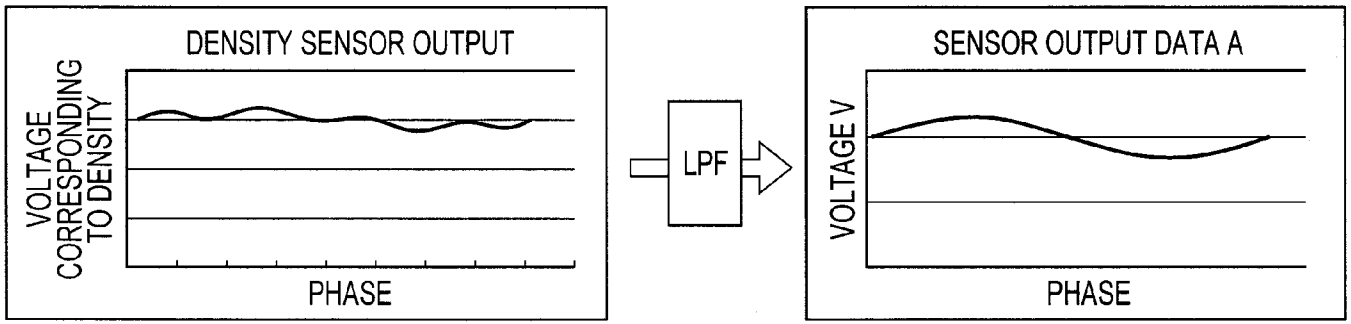
FIGS. 4A and 4B illustrate performance characteristics of an LPF and a BPF according to the embodiment.
Figure 4B:
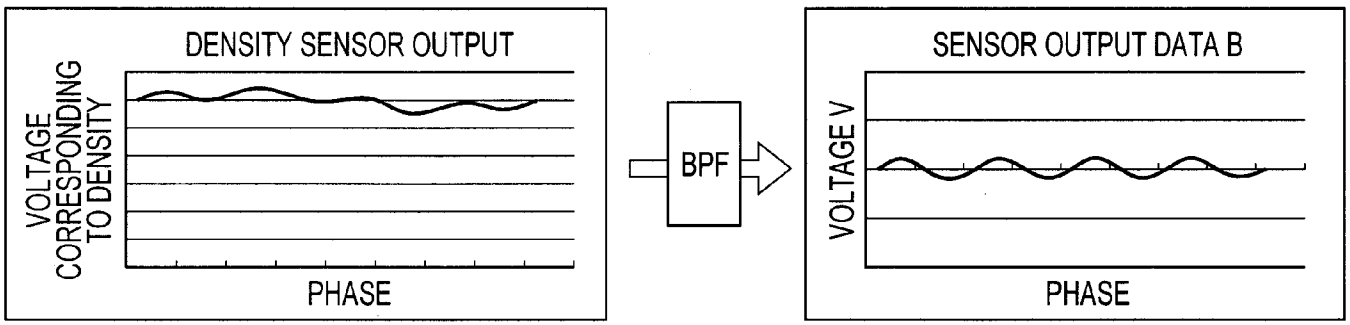
Figure 5A:
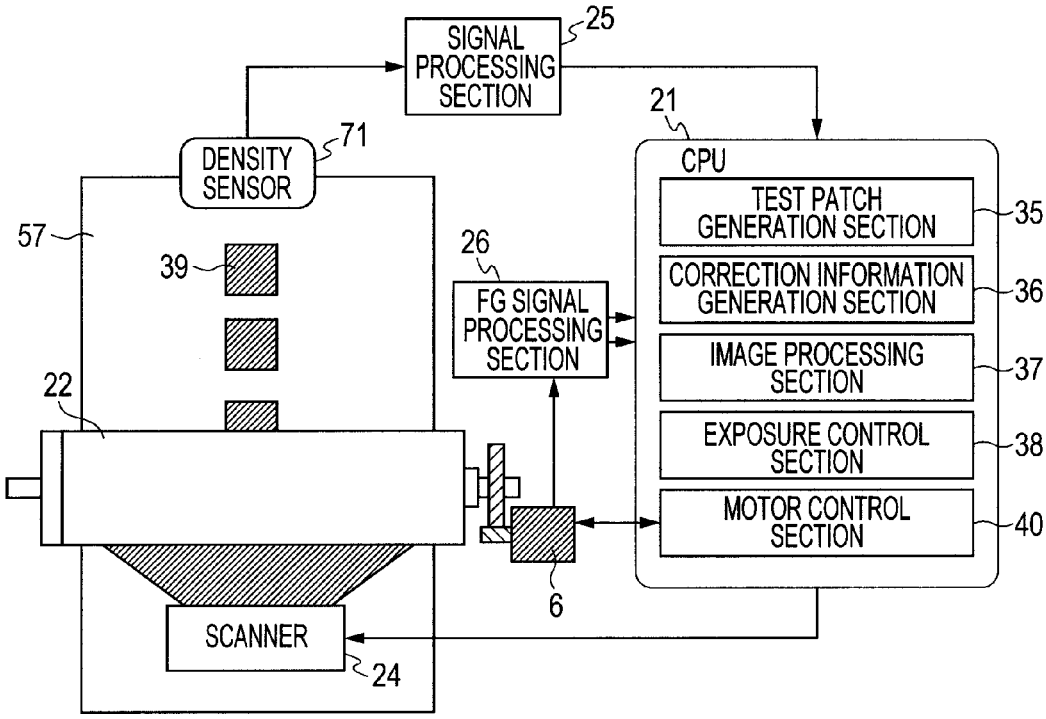
FIGS. 5A and 5B illustrate function blocks in the embodiment.

FIG. 5A illustrates a relationship between a part of the components of the color image forming apparatus, a part of the block diagram illustrated in FIGS. 3A to 3C and the function block diagram of the functions controlled by the CPU 21. Components that are the same as those in FIG. 1A and FIGS. 3A to 3C are provided with the same reference numerals as those in FIG. 1A and FIGS. 3A to 3C, and a detailed description thereof will be omitted. In FIG. 5A, a test patch generation section 35 performs control to form a detection pattern (hereinafter referred to as "test patch") 39 including a toner image for density detection, on the intermediate transfer member 57. A detection pattern may also be referred to as an inspection image or an inspection pattern. Based on data in the test patch 39, the test patch generation section 35 forms an electrostatic latent image on a photosensitive drum 22 by means of a scanner 24. Then, the test patch generation section 35 develops the electrostatic latent image by means of a non-illustrated developing device 56 to form a toner image (test patch) on the intermediate transfer member 57. Then, the density sensor 71 applies light to the formed test patch 39, detects characteristics of the reflected light, and inputs a result of the detection to the signal processing section 25. Based on the detection result for the test patch 39 detected by the density sensor 71, correction information generation section 36 generates density correction information, which will be described later with reference to FIGS. 9A to 9C. An image processing section 37 performs image processing such as halftone processing on various kinds of images. An exposure control section 38 makes the scanner 24 provide exposure in synchronization with an FG count value to form the test patch 39 on the intermediate transfer member 57 through an electrophotographic process.

Figure 5B:
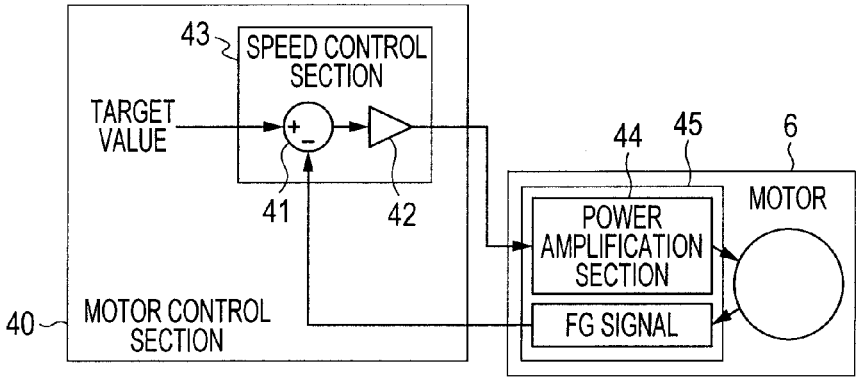

FIG. 5B illustrates the details of a motor control section 40. In FIG. 5B, in order to control the motor 6 to have a predetermined speed, a speed control section 43 multiplies a value obtained by a difference calculation unit 41 that calculates a difference between a target value and speed information obtained from the FG signal for the motor 6, by a control gain 42 and outputs the resulting value as a control amount. The speed control section 43 performs control so that if the speed information obtained from the motor 6 is lower than the target value, the control amount is increased, and if the speed information obtained from the motor 6 is higher than the target value, the control amount is decreased in order for the speed of the motor 6 to meet the target value. Furthermore, the motor control section 40 can change and set the control gain 42 for the motor 6. A motor control IC 45 determines the amount of power supplied by a power amplification section 44 to the motor 6 according to the control amount input from the motor control section 40.

For the relationship between the hardware configuration and the function blocks, the mode illustrated in FIGS. 3A to 3C and FIGS. 5A and 5B is a mere example and the relationship in the present invention is not limited to such example. For example, a part or all of the functions provided by the CPU 21 in FIGS. 3A to 3C and FIGS. 5A and 5B may be provided by an application specific integrated circuit. Also, contrarily, a part or all of the functions provided by the application specific integrated circuit in FIGS. 3A to 3C and FIGS. 5A and 5B may be provided by the CPU 21.

[Flowchart for Exposure Output Correction Table Creation Processing]

Figure 6:
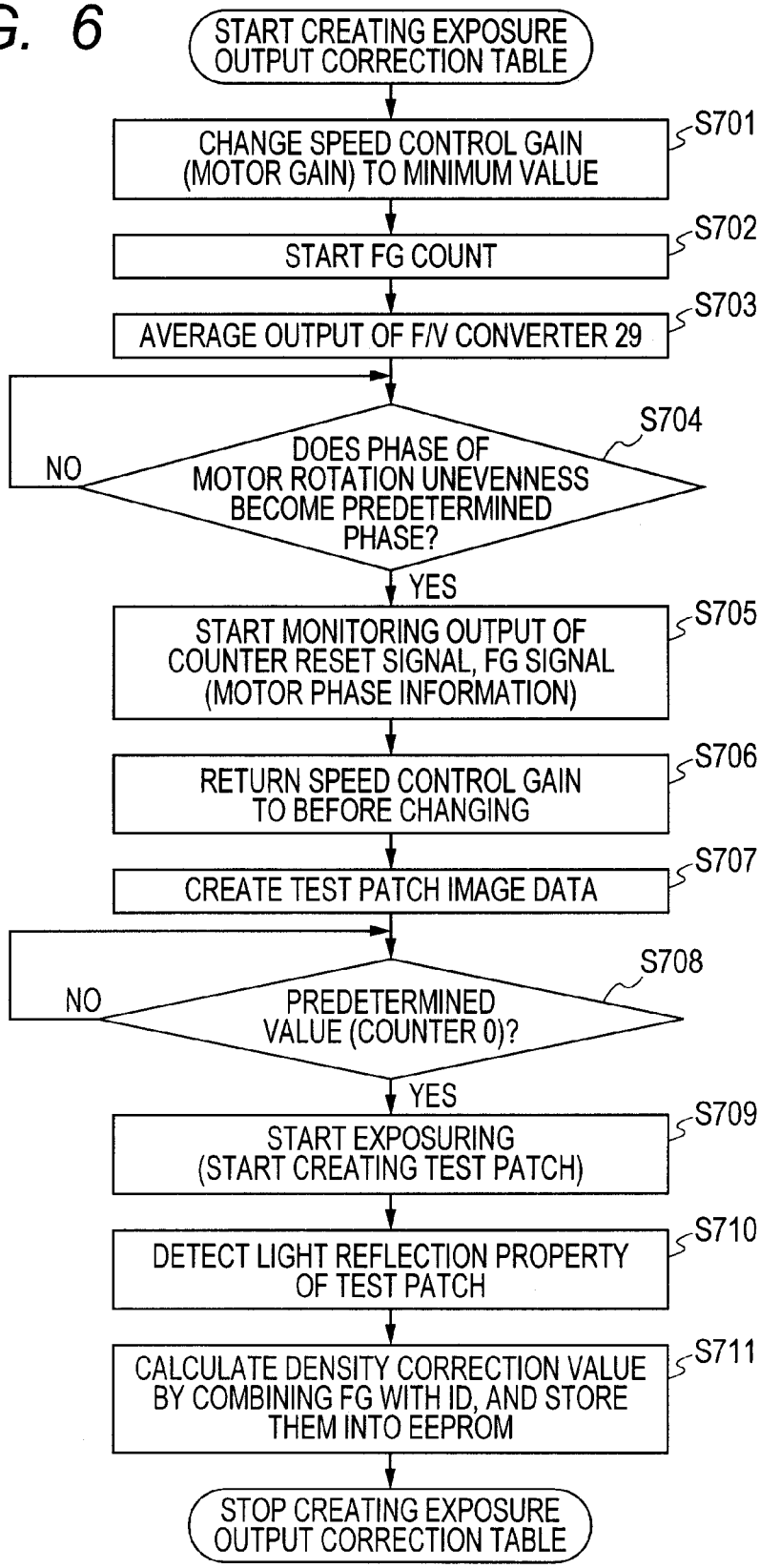
FIG. 6 is a flowchart illustrating exposure output correction table creation processing according to the embodiment.

FIG. 6 is a flowchart for an embodiment of exposure output correction table creation processing. According to the flowchart in FIG. 6, the relationship between phase information for the motor 6 and banding is obtained and density correction information for the banding is calculated to create to a table for relationship between the phase information for the motor 6 and the density correction information. Then, the table created here is used for banding reduction at the time of subsequent performance of printing. A specific description will be provided below.

First, upon start of exposure output correction table creation processing, the motor control section 40 confirms in step (hereinafter referred to as "S") 701 that the motor 6 has a rotational frequency in a predetermined range, and subsequently, changes a speed control gain (motor gain) in a control gain 42 of the control speed control section 43 to a minimum value. The gain setting is not limited to the gain setting to the minimum value, and setting of the gain to a setting value that is at least smaller than a value for normal image formation increases rotation unevenness for the cycle of one rotation of the motor 6, enabling easy detection of the rotation unevenness. Here, normal image formation refers to image formation according to image data, for example, input from a computer external to the image forming apparatus, which has been created according to a user' operation of the computer. In other words, normal image formation refers to image formation for a case where such image data is input to the image forming unit 60 to form an image.

Subsequently, in S702, in order to detect the rotational phase of the motor 6, the CPU 21 starts counting for the FG signal for the motor 6 by turning the switch SW31 on via the SW control section 33 by means of the FG signal processing section 26. Then, in S703, the determination section 32 extracts an output of the F/V converter 29, that is, rotation unevenness for the cycle of one rotation of the motor 6, which have been processed by the LPF 30 and averaged. Also, in S704, the determination section 32 determines whether or not the phase of the motor rotation unevenness for the W1 component is a predetermined phase. In the present embodiment, whether or not the phase of the rotation unevenness of the motor 6 is, for example, 0. If it has been determined in S704 that the phase is the predetermined phase, in S705, the determination section 32 outputs a counter reset signal to reset the FG counter 34. Also, upon receipt of the counter reset signal from the determination section 32, in S705, the CPU 21 starts monitoring the count value of the FG signal, which is motor phase information. As a result of the CPU 21's monitoring of the count value of the FG signal, the phase of the motor is identified. The CPU 21's monitoring of the count value of the FG signal is continued until the end of the print job.

In S706, the motor control section 40 returns the setting for the control gain 42 from the minimum value to an original setting value (setting value before the change). Consequently, in test patch formation, conditions that are the same for those for normal image formation can be employed for the control gain 42. In S707, the test patch generation section 35 creates test patch data for a test patch 39. In S708, the test patch generation section 35 determines whether or not the count value for the FG signal for the motor 6 reaches a predetermined value (for example, "0" (counter=0)). If it has been determined in S708 that the count value reaches the predetermined count value, in S709, the test patch generation section 35 makes the scanner 24 start exposure, that is, test patch formation. It should be noted that the density correction table is not used for test patch formation. In S710, the density sensor 71 detects reflected light from the test patch 39 formed on the intermediate transfer member 57. Here, the result of detection by the density sensor 71 is input to the CPU 21 via the signal processing section 25. There are three types of signals input to the CPU 21 as described above with reference to FIG. 3B.

In S711, the correction information generation section 36 calculates, based on the result of the detection in S710, a density correction value for reducing banding resulting from rotation unevenness of the motor 6. Also, the correction information generation section 36 stores the calculated density correction value in the memory section (EEPROM). For a more specific description, first, the correction information generation section 36 calculates an average value for density (hereinafter referred to as "Dave") based on the detection result in S710. Next, the correction information generation section 36 calculates a density value Dn for each rotational phase of the motor 6, and compares Dave and Dn for each rotational phase of the motor 6 (FG count value) to obtain the difference therebetween. Next, the correction information generation section 36 obtains a correction value Dcn by means of an arithmetic expression of Dcn=Dave/Dn=Dave/(Dave+difference value). Then, the correction value Dcn here calculated is reflected in the density of image information, or reflected in, e.g., a control signal for directly driving the scanner 24, rather than image information. For example, it is assumed that Dave=10, and the detected density is higher than the average by substantially 5%, i.e., Dn=10.5. In this case, Dave/Dn=10/10.5=10/(10+0.5)=0.952. In this example, for Dn=10.5, for example, a signal for controlling the time and/or intensity of exposure provided by the scanner 24 may be multiplied by 0.952. Then, the CPU 21 relates the correction value calculated in S711 and the FG count value (FG-ID) to each other and stores the values in the memory section 50 (EEPROM). As described above, an exposure subjected to density correction according to the phase of the rotation unevenness of the motor 6 can be provided by the scanner 24.

Here, in the processing in S710, as described with reference to FIG. 3B, the W1 and W4 components are extracted by LPF 27 and BPF 28, respectively. The timing for stating detection of reflected light for extraction of the W4 component is the same as that for the W1 component. Furthermore, in the processing in S711, based on banding of each of the detected W1 and W4 components, the correction information generation section 36 calculates correction information for correcting the unevenness of each of the W1 and W4 components. Then, upon end of processing in the respective steps above, the exposure output correction table creation processing is terminated.

[Processing for Relation between a Motor Phase and Density Variation of a Toner Image]

Figure 7A:
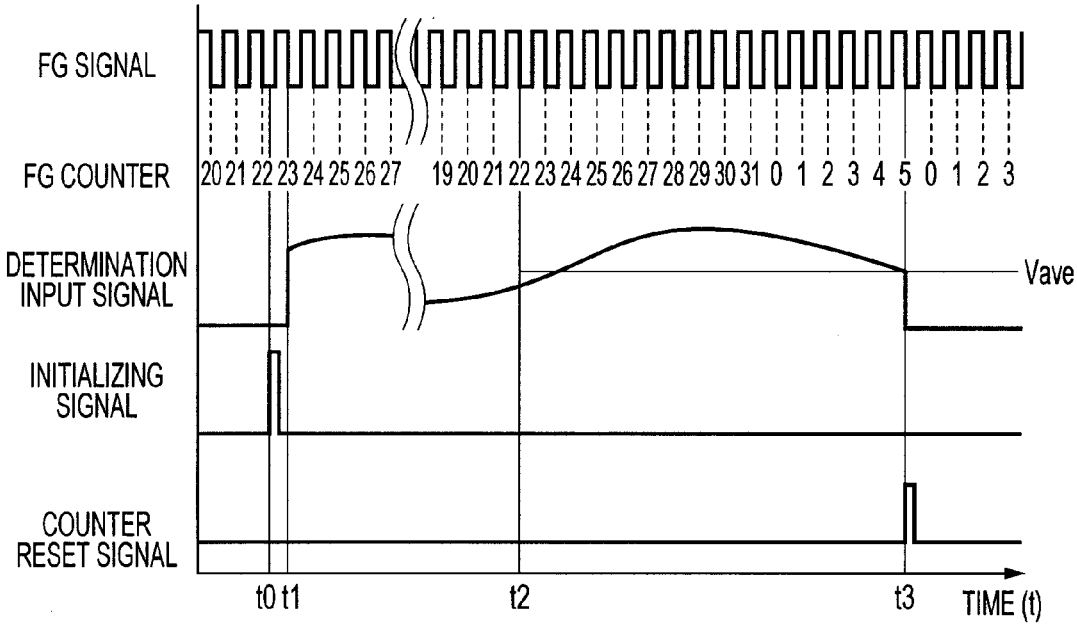
FIG. 7A illustrates processing for initializing an FG signal according to the embodiment.

FIG. 7A is a diagram illustrating the details of the processing in S701 to S705 in FIG. 6, and is a timing chart for an embodiment of counter reset processing (initializing processing) for an FG count value of the motor 6. According to the timing chart illustrated in FIG. 7A, a phase (in the example, a phase 0 ($FG_0$)) corresponding to a state of variation of the speed of the motor 6 can be determined. In the example in FIG. 7A, a state in which the speed of the motor 6 crosses the point of an average value in the course of changing from the state of a speed higher than the average to the state of the speed lower than the average is allocated to the phase 0 ($FG_0$). FIG. 7A is a mere example, and any or a predetermined speed variation state of the motor 6 may be allocated to any of phases (for example, the phase 0 ($FG_0$)). It is only necessary that with the view to reproducibility, any or a predetermined speed state of the motor 6 be allocated to any of phases of the motor 6 (any or a predetermined phase) so that the phase to which the speed state has been allocated can be determined in the subsequent processing. As a result, at another timing, various types of processing can be performed using the phase of the motor 6 as a parameter. The timing chart in FIG. 7A is an embodiment of such processing. A specific description will be given below.

First, upon the CPU 21 outputting an initializing signal to the FG signal processing section 26 at a timing t0, the initializing signal is input to the SW control section 33. The SW control section 33 turns the switch SW31 on in synchronization with a pulse of the FG signal input first after the timing t0 to start FG count (S702). Between timings t1 to t2 (FG signal for one rotation of the motor), the determination section 32 calculates an average value Vave for input values from the LPF 30. The determination section 32 compares the calculated average value Vave and a value input from the LPF 30 after the timing t2, and outputs a counter reset signal at a timing t3 for meeting a predetermined condition that, for example, the input value crosses the point of the average value Vave in the course of transition from the higher side to the lower side (YES in S704).

In the case where the counter reset signal is received at the timing t3, the FG counter 34 resets the count to "0". Also, upon receiving of the counter reset signal, the CPU 21 recognizes that the initialization of the phase information (FG count value) has been completed. After the reset, the CPU 21 continues monitoring of the FG counter 34.

Figure 7B:
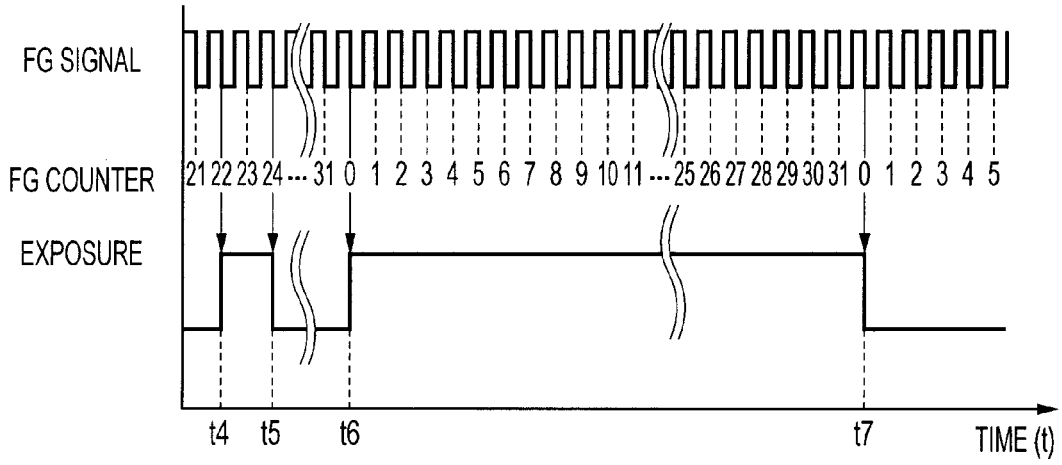
FIG. 7B is a timing chart for processing for exposure of a test patch.

FIG. 7B illustrates an example of a timing chart for exposure of a test patch for a toner image (test patch formation), and is a diagram illustrating the details of the processing in S707 in FIG. 6. In the timing chart in FIG. 7B, it is assumed that the count of the FG signal is continued from the processing in FIG. 7A. In other words, it is assumed that the CPU 21 continuously identifies the phase of the rotation unevenness of the motor 6 according to change in the FG count value. A description will be given below with reference to FIG. 7B.

First, the test patch 39 includes a pre-patch for read-in timing generation and a normal patch for banding measurement. At a timing t4 before reaching a predetermined FG count value for start exposure of the normal patch (at the timing an FG count of 10 before exposure of the normal patch in the present embodiment), the test patch generation section 35 starts formation (exposure) of a pre-patch. The pre-patch is provided for synchronization with a timing for the density sensor 71 to start detection for the test patch 39, and the pre-patch may have a small length. For example, it is unnecessary that the pre-patch has a length corresponding to the cycle of one rotation of the motor, and it is sufficient that the pre-patch has a length sufficient for detection by the density sensor 71. In FIG. 7B, time for exposure of the pre-patch corresponds to the count of two in the FG count and the exposure for the pre-patch is stopped at a timing t5.

Figure 7C:
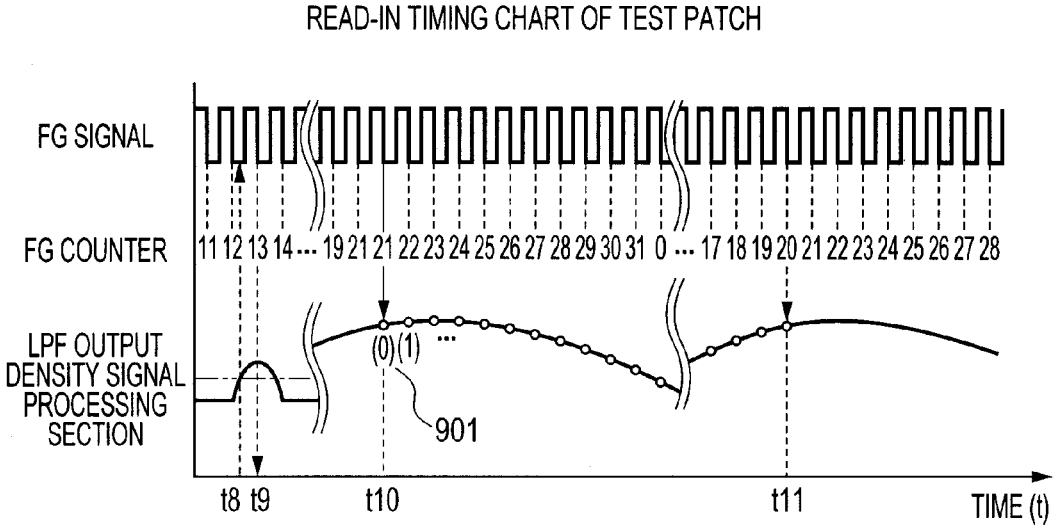
FIG. 7C is a timing chart illustrating read-in processing.

Then, the test patch generation section 35 starts exposure for the normal patch when the FG count reaches 0 at a timing t6 (S709). Subsequently, the exposure is continued until at least the FG count corresponding to no less than one rotation of the motor is made (t7). Then, after the electrophotographic process described with reference to FIG. 1A, finally, a test patch 39 is formed as a toner image on the intermediate transfer member 57. FIG. 7C is a timing chart for reading the test patch 39, and is a diagram illustrating the details of S710 in FIG. 6. In the description, based on FIG. 7B, the test patch generation section 35 has started exposure for the test patch 39 after the FG count of 10 from the start of the exposure of the pre-patch. Therefore, the test patch 39 is read after the elapse of the count of (10+32n (n is an integer of no less than 0)) from the density sensor 71's detection of the pre-patch. At a timing t8, the density sensor 71 detects the pre-patch, and with a timing t9, at which the next FG pulse is detected, determined as a starting point, the CPU 21 starts read-in of the test patch at a timing t10, which is the time after elapse of the count of (10+32n (n is an integer of no less than 0)). A threshold value for determining that the pre-patch has been detected at the timing t8 may arbitrarily set in consideration of, e.g., the density of the patch and/or possible banding amplitude of the patch.

Figure 8A:
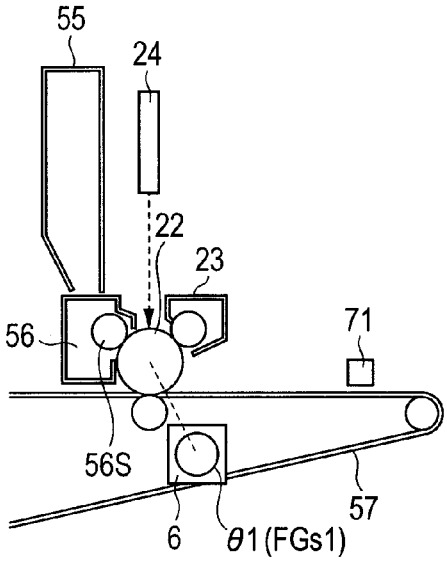
FIGS. 8A, 8B and 8C illustrate a relationship between a rotation unevenness phase of a motor and an exposure timing according to the embodiment.
Figure 8B:
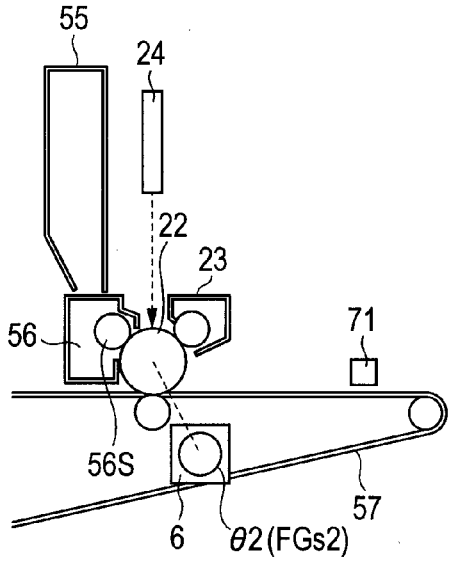
Figure 8C:
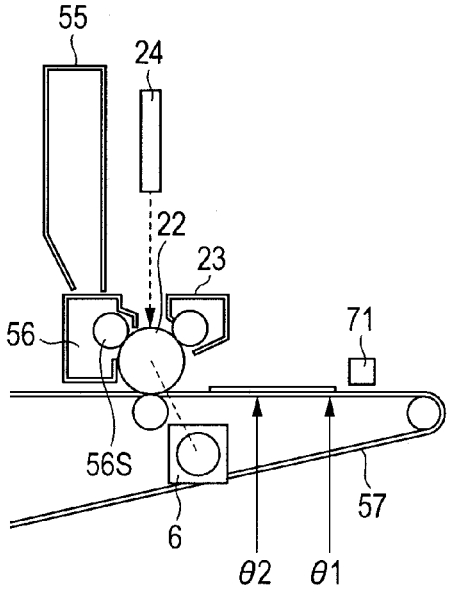

A point 901 in the Figure indicates the FG signal controlled by the CPU 21, which is phase information for the motor 6 recognized by the CPU 21 when the normal test patch 39 whose optical property values have been read was exposed. FIGS. 8A to 8C schematically illustrates such state.

FIGS. 8A to 8C are diagrams schematically illustrating a relationship between an exposure timing for the scanner 24 and phase information for the motor 6 recognized by the CPU 21 at that timing. FIGS. 8A and 8B each indicate a state in which the CPU recognizes phase information for the motor 6 when forming an electrostatic latent image of the test patch 39. In the Figures, an FG count value FGs1 corresponds to a phase θ1 and a FG count value FGs2 corresponds to a phase θ2. FIG. 8C is a diagram indicating such pieces of phase information for the motor 6 during image exposure corresponding to respective positions along the movement direction of the formed test patch 39. The relationship indicated in FIG. 8C is also controlled by the CPU 21.

Although not illustrated in FIG. 7C, in reality, a result of detection of an optical property value of the W4 component is also output in synchronization with the timing t10 from the BPF 28 and input to the CPU 21. The optical property value of the test patch 39 obtained by the density sensor 71 is input to the CPU 21 via the LPF 27 and the BPF 28 in the signal processing section 25. The CPU 21 relates the optical property value (corresponding to the density value) output from the signal processing section 25 and the phase information (FG count value) for the motor 6 when the detection target pattern was formed to each other and stores the value and information in the memory section (EEPROM). When a result of the density sensor 71's detection for an FG count corresponding at least one rotation of the motor is obtained at a timing t11, the CPU 21 terminates the read-in of the test patch 39.

For the density sensor 71's read-in of the optical property in the timing chart in FIG. 7C, an optical property value may be read a plurality of times around white circle points in FIG. 7C to use the read values as optical property values read by the density sensor 71. Furthermore, the detection value input from the density sensor 71 to the CPU 21 at the timing t10 is one passing through the LPF 27. Accordingly, the accuracy of the detection value input to the CPU 21 may be insufficient depending on the frequency properties of the LPF 27. In such case, use of a detection value corresponding to, for example, the 32nd (eighth in the case of W4) FG count value from the timing t10 instead enables further enhancement of the accuracy of detection by the density sensor 71.

[Banding Component of the Test Patch 39]

The detection result for the test patch 39 includes an effect of rotation unevenness of the motor 6 during exposure as well as an effect of rotation unevenness of the motor 6 during transfer. In other words, during exposure and during transfer, respective rotation unevenness is generated from a same source. Banding resulting from combination of the aforementioned rotation unevenness effects is detected from the test patch 39. The banding results from a physical shape of the motor 6, and thus, a phase of rotation unevenness for a cycle of one rotation of the motor 6 can be reproduced according to the physical state of the motor 6.

[Example of the Exposure Output Correction Table]

FIGS. 9A to 9C illustrate an example of an exposure output correction table created by the processing in S711 in the flowchart in FIG. 6. Information on the tables illustrated in FIGS. 9A to 9C is information stored in the memory section 50 (EEPROM), and during image formation, the CPU 21 performs banding correction (density correction by means of exposure control) according to the phase of rotation unevenness of the motor 6 with reference to the tables.

Tables A in FIGS. 9A and 9B each indicate a relationship between motor phases and density values of a toner image. In FIGS. 9A and 9B, the tables A are created for the W1 and W4 components, respectively. Here, for the W1 component, each density value illustrated in FIG. 9A can be calculated by converting a voltage value V1 detected via the LPF 27 into a density value. Also, for the W4 component, each density value can be calculated by converting a detection result obtained via the BPF 28 into a density value and adding an average density value to the density value. The average density value may be obtained from the detection result for the W1 component, or may also be obtained by averaging the raw sensor output data illustrated in FIG. 3B by means of the correction information generation section 36. Next, the correction information generation section 36 calculates differences Δd1 and Δd2 between the respective density values and the average value for the W1 and W4 components, respectively, and creates tables B with the calculated differences Δd1 and Δd2 related to information for the respective phases. Then, the correction information generation section 36 adds up the differences Δd1 and Δd2 related to the information for the respective phases, which are stored in the tables B, thereby summing up the difference values for the W1 and W4 components. The resulting table is illustrated as a table C in FIG. 9C.

The correction information generation section 36 calculates a density correction value based on the summed difference related to the information for each phase. Where the density value for a certain phase FGn of the motor 6 is Dn and an average property is Dave, the density correction value Dcn can be obtained by Dcn=Dave/(Dave+summed difference). The table of the calculated correction information is illustrated as a table D. The table D is an exposure output correction table. Then, the density correction value Dcn is multiplied by, for example, an exposure output. Also, where there is no proportional relationship between an exposure output and a density, a multiplying value according to an amount of change in density is arbitrarily related to the information for each phase. Then, the CPU 21 stores the calculated table D information in the memory section 50 (EEPROM) so that such information can be reused. Furthermore, addition of data interpolated between pulses of the FG signal to the density correction value Dcn enables creation of a smoother correction pattern. As described above, the present embodiment can respond to a case where rotation unevenness having a plurality of cycles (i.e., frequencies) is caused to occur by one motor 6, which is a rotary member, and affect banding, and thus, can make a sensitive response. For the exposure output correction table, the description has been provided in terms of a case where the zero phases for the banding phases (corresponding to the motor rotation unevenness phases) for the W1 and W4 components correspond to each other, the exposure output correction table according to the present invention is not limited to such case. Depending on the mechanical configuration particular to the motor, the zero phases of the banding phases for the W1 and W4 components may not correspond to each other. Even in such case, an exposure output correction table corresponding to that in FIG. 9C can be created according to the above-described embodiment.

[Flowchart of Image Data Correction Processing]

Figure 10A:
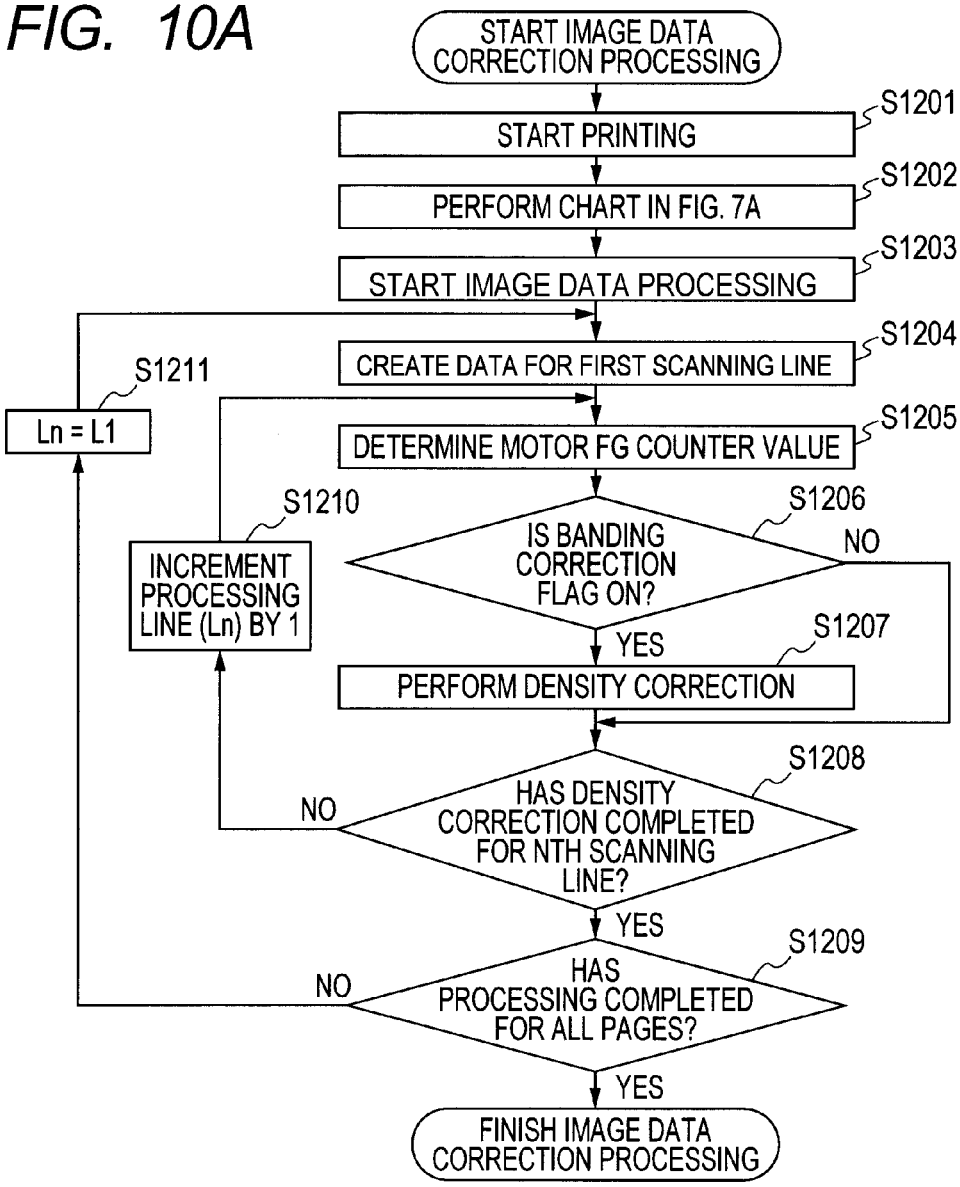
FIG. 10A is a flowchart illustrating image data correction processing according to the embodiment.

FIG. 10A is a flowchart illustrating an embodiment of image data correction processing according to a phase of rotation unevenness of the motor 6. It is assumed that similar processing is performed for the respective colors of Y, M, C and K. According to the flowchart illustrated in FIG. 10A, banding correction for an image is performed using banding correction information related to the phase of rotation unevenness of the motor 6. Banding correction information here refers to banding correction information corresponding to respective phases of the motor, which is a rotation member, described with reference to FIGS. 9A to 9C.

First, the flowchart in FIG. 10A will be described. In S1201, the CPU 21 starts image formation (printing), and in S1202, the CPU 21 performs an operation illustrated in the timing chart in FIG. 7A to reset the FG counter, and starts continuous monitoring of the FG count value. In S1203, the image processing section 37 starts image data processing for every scanning line. Then, in the below processing, the image processing section 37 repeats exposure processing involving exposure of n scanning lines per page for the number of pages in a print job.

Figure 10B:
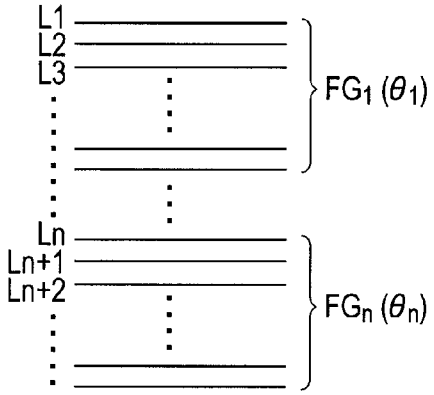
FIG. 10B illustrates a relationship between a rotational phase of a motor and a plurality of scanning lines.

In S1204, the image processing section 37 reads in image data for a first scanning line L1. Then, in S1205, the image processing section 37 determines a phase of the motor 6 (FG count value FGs) for the current attention scanning line in order to determine a density correction value for a density DL1 of the first scanning line L1. A method for the determination will be described in details later with reference to FIGS. 11A and 11B. Here, in the present embodiment, 32 pulses of the FG signal are output during one rotation of the motor 6, and thus, the motor 6 rotates by 11.25 degrees for one FG pulse. In other words, a same phase (FG count value) is set for a plurality of scanning lines scanned each time the motor 6 rotates by 11.25 degrees. FIG. 10B illustrates an example of the relationship between the phases of the motor 6 (e.g., FG1(θ1)) and the plurality of scanning lines (e.g., L1 . . . Ln).

Subsequently, in S1206, the image processing section 37 determines whether or not a banding correction flag indicating that a correction function normally operates is "ON", if the image processing section 37 has determined in S1206 that the density correction flag is "ON", the image processing section 37 moves the processing to density correction in S1207. Meanwhile, if the image processing section 37 has determined in S1206 that the density correction flag is not "ON", the image processing section 37 moves the target for the density correction processing to a next scanning line without performing density correction in S1207 for the image data for the attention scanning line. Even if density correction in S1207 is not performed, density correction may be performed using, e.g., a γ table for conversion of a tone value of image data as conventionally known. A description of such known density correction will be omitted.

According to the FG count value FGs determined in S1205, the image processing section 37 reads in corresponding density correction information from the exposure output correction table (FIG. 9C) and performs banding correction by multiplying a tone value of image information by the density correction information or multiplying a signal for controlling exposure time or an exposure intensity by the density correction information. In reality, in response to the determination of "YES" in S1206, respective phases of the rotation unevenness of the motor 6 are allocated to respective line images in the sub-scanning direction, and image processing according to the phases (FGs) corresponding to the respective line images is performed.

In S1208, the CPU 21 determines whether or not the density correction processing has been completed for a predetermined scanning line (the last scanning line in the page scanning line (for example, an n-th scanning line)), and if the density correction processing has not been completed, the CPU 21 advances (increments) Ln (line to be processed) by one in S1210. Then, the image processing section 37 performs processing in S1205 to S1207 for the next scanning line. Meanwhile, if processing for the predetermined number of scanning lines has been completed, and the CPU 21 has determined in S1208 that density correction has been completed up to the n-th scanning line, in S1209, the CPU 21 determines whether or not processing has been completed for all the pages. The CPU 21 determines in S1209 that the processing has not been completed for all the pages, in S1211, the CPU 21 initializes a parameter of Ln to L1, and performs the processing in S1204 onwards for a next page. Then, if the CPU 21 determines in S1209 that the processing has been completed for all the pages, the CPU 21 terminates the image data correction processing.

Figure 11A:
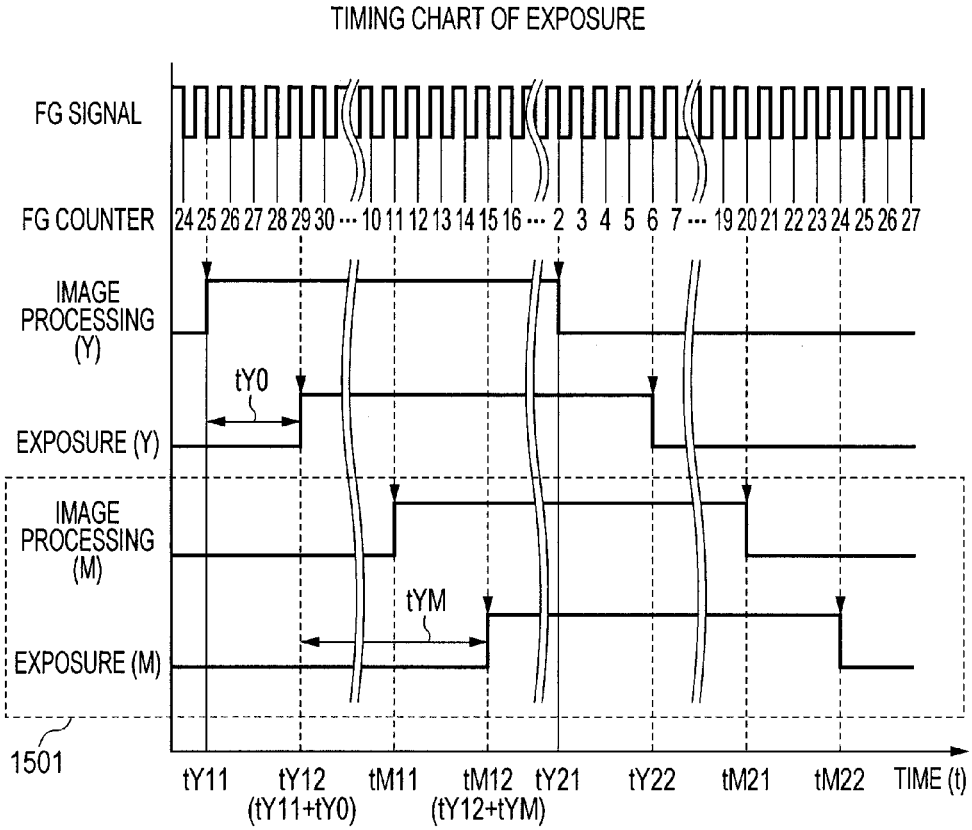
FIG. 11A is a timing chart for image processing and exposure according to the embodiment.
Figure 11B:
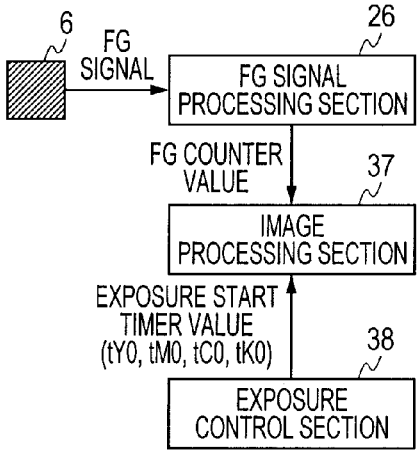
FIG. 11B illustrates main function blocks.

Hereinafter, the details of the processing related to S1205 will be described. FIG. 11A is a timing chart illustrating image data correction processing and exposure processing according to phases of rotation unevenness of the motor 6. FIG. 11A illustrates image data correction processing for a forward part of one page. According to the timing chart illustrated in FIG. 11A, banding correction for an image can be performed using density correction information (the exposure output correction table in FIG. 9C) related to rotation unevenness phases of the motor 6. FIG. 11B is a block diagram of main functions related to FIG. 11A. Components that are the same as those in FIGS. 5A and 5B are provided with the same reference numerals as those in FIGS. 5A and 5B. A specific description will be given below.

First, at a timing tY11, the image processing section 37 receives, from the exposure control section 38, a notice that exposure will be started tY0 seconds later. The image processing section 37, which is continuously notified from the FG signal processing section 26 of the FG count value, calculates an FG count value for a timing tY12, which is tY0 seconds later from the present time, according to the FG count value at the timing tY11 provided by the exposure control section 38. FIG. 11A indicates that the FG count value at the time of receipt of the notice is 25 and the calculated FG count value at the time of exposure is 29. Then, based on the calculated FG count value at the time of start of exposure, the corresponding density correction information is read in from the exposure output correction table (FIG. 9C), and density correction (banding correction) is performed for an image for a first scanning line. For colors other than yellow, processing similar to that performed for yellow is performed separately.

Where the photosensitive drums 22 for yellow and magenta are driven by a common motor 6, the following processing can be performed. The relationship in exposure timing between yellow and magenta (other color) is fixed, and thus, an FG count value for a timing for starting exposure for magenta (other color) may be calculated from the FG count value at the timing tY11 when the notice was received from the exposure control section 38. A dotted rectangular frame 1501 in FIG. 11A indicates such operation. In this case, a common FG count value may be shared between yellow and magenta. In the relationship illustrated in FIG. 11A, there is a difference of tYM between the exposure start timings for yellow and magenta. Accordingly, adding an FG count value corresponding to the time of tYM to the FG count value corresponding to the timing tY12 enables identification of a rotation unevenness phase of the motor at the time of exposure for magenta, and thus, the corresponding density correction information may be read in from the exposure output correction table (FIG. 9C). The above-described method also enables a scanner 24 to perform exposure (tM12 to tM22) changed according to rotation unevenness phases of the motor 6 (corresponding to banding phases) for magenta.

Here, as described above with reference to FIG. 10B, a same FG count value (phase) is set for a plurality of scanning lines scanned during the motor 6 rotating by 11.25 degrees. In other words, an FG count value that is the same as that for the aforementioned first scanning line is allocated to the plurality of scanning lines corresponding to the rotation by 11.25 degrees of the motor 6, and a next FG count value is allocated to a plurality of scanning lines corresponding to a next rotation by 11.25 degrees of the motor 6. Rather than the FG count value-based allocation, more precise rotation unevenness phases of the motor 6 may be obtained based on the FG count value and allocated to respective scanning lines, thereby providing more precise banding correction.

Then, the image processing section 37 performs density correction for image data based on the density correction information read from the exposure output correction table (FIG. 9C) according to the FG count value (rotation unevenness phase of the motor 6) related to respective scanning lines. Then, as a result of the density correction, during a period from tY12 to tY22, the scanner 24 can perform exposure changed according to the rotation unevenness phases of the motor 6 (corresponding to banding phases). For the colors other than yellow, as in the case of yellow, exposure by means of the corresponding scanner 24 is performed.

Figure 12A:
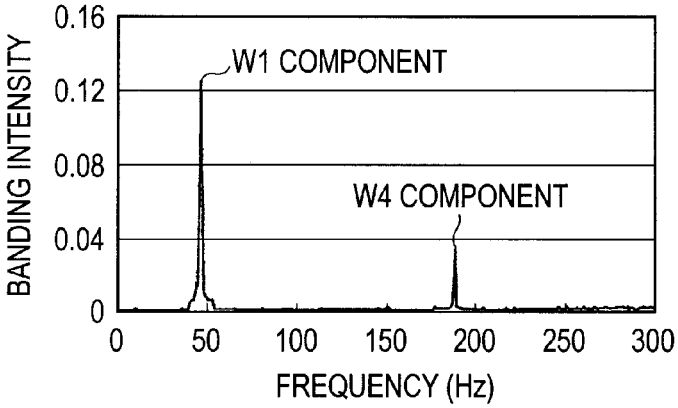
FIGS. 12A and 12B are graphs indicating banding reduction effects according to the embodiment.
Figure 12B:
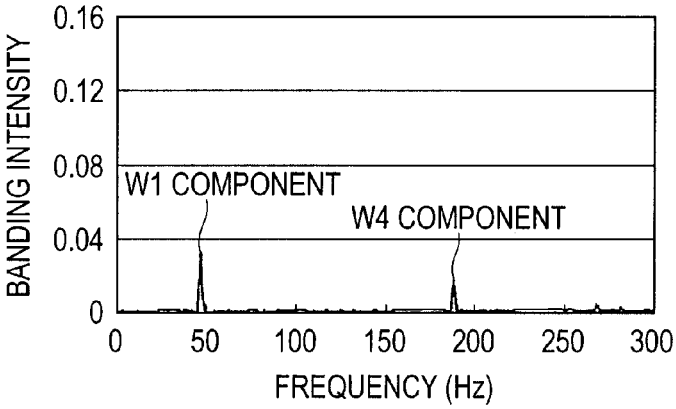

As described above, the image data correction processing illustrated in FIG. 10A enables effective suppression of banding resulting from rotation unevenness of the motor 6 by means of performing density correction in synchronization with the FG signal, which is phase information for the motor 6. Furthermore, although rotation unevenness occurs with a plurality of cycles of different types during the motor 6 making one rotation, the processing illustrated in FIG. 10A enables effective suppression of banding even in such case. FIGS. 12A and 12B illustrates an effect in such case. FIG. 12A illustrates banding when the present embodiment was not employed, and FIG. 12B illustrates banding when the present embodiment was employed. The ordinate axis in the graph represents banding intensity, and thus, it can be seen that banding intensities for the W1 and W4 components are simultaneously suppressed.

As described above, the above-described embodiment enables reduction of banding resulting from rotation unevenness of the motor 6. Also, focusing on the rotation unevenness of the motor 6, similar banding does not always occur at a same position of each transfer material 11. However, the above-described embodiment also enables proper banding correction even in such case. Furthermore, the following effect can be obtained since a signal (FG signal in the above description) output for every rotation of the motor 6 is directly obtained to identify the phase of rotational speed unevenness of the motor. When the ratio between the number of teeth of the pinion gear in the motor 6 and the number of teeth of a gear to be engaged with the pinion gears (for example, a drum drive gear) is an integer, the rotation unevenness phase of the motor 6 can be identified indirectly from detection of markings provided to the gear engaged with the pinion gear in the motor 6. However, as described above, this can be provided on the premise that the ratio between the number of teeth of the pinion gear in the motor 6 and the number of teeth of the gear engaged with the pinion gears is an integer. Meanwhile, the present embodiment described above enables identification of a rotation unevenness phase of the motor 6 with no such restriction in mechanical configuration relating to the number of teeth. Consequently, a mechanical design with a high degree of freedom for gears can be provided.

[Processing for Determining the Necessity or Non-Necessity for Performing Exposure Output Correction Table Re-Creation Processing]

Figure 13:
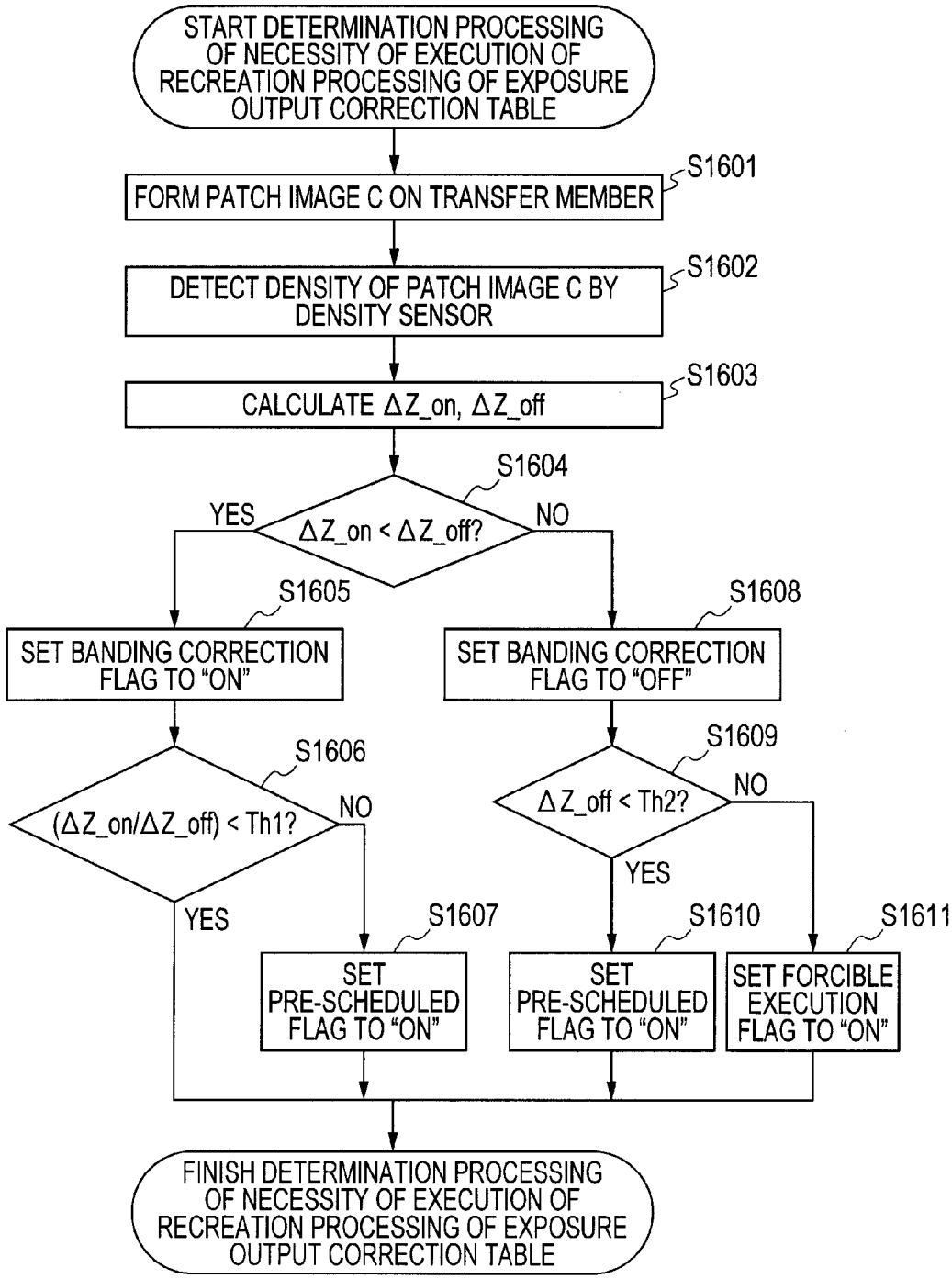
FIG. 13 is a flowchart for determination of the necessity or non-necessity of execution of exposure output correction table re-creation processing according to the embodiment.

FIG. 13 illustrates a flow of processing for determining the necessity or non-necessity for performing exposure output correction table re-creation processing. The determination processing in FIG. 13 is first performed at least once before a request for printing is received externally when, e.g., the image forming apparatus is powered on. Upon start of processing for determining the necessity or non-necessity for performing exposure output correction table re-creation processing, the test patch generation section 35 creates a test patch C between print images, and forms the test patch C on the intermediate transfer member 57 (S1601).

Figure 14A:
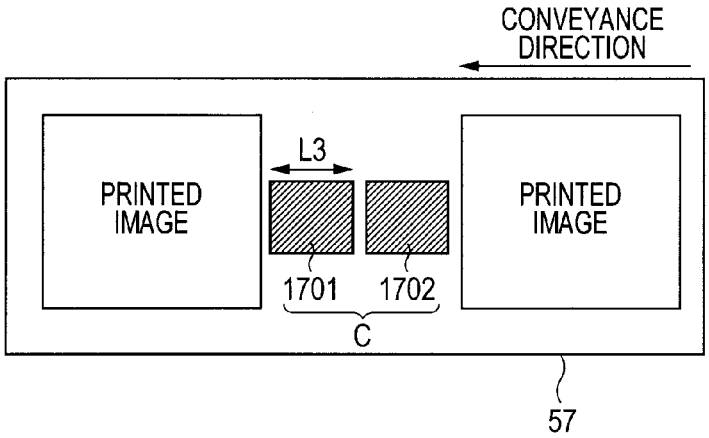
FIG. 14A illustrates a test patch C in the embodiment.

FIG. 14A illustrates the test patch C formed on the intermediate transfer member 57. The test patch C, which includes two test patches 1701 and 1702 with certain tones, is formed between print images. The test patches 1701 and 1702 may be formed between transfer materials. Where a plurality of test patches is formed, such test patches may be referred to a first test patch (first inspection image) and a second test patch (second inspection image) for distinction between the test patches.

The test patch 1701 is a patch subjected to banding correction as a result of the banding correction flag being set to "ON" during formation of the patch. The test patch 1702 is a patch not subjected to banding correction during formation of such patch as a result of the banding correction flag being set to "OFF".

Densities of the test patch C formed on the intermediate transfer member 57 are detected by the density sensor 71 (S1602). For the density detection here, the intensity of reflected light from each scanning line is detected in the direction of conveyance of the test patch C, and the density of the scanning line is calculated from the detected intensity.

Figure 14B:
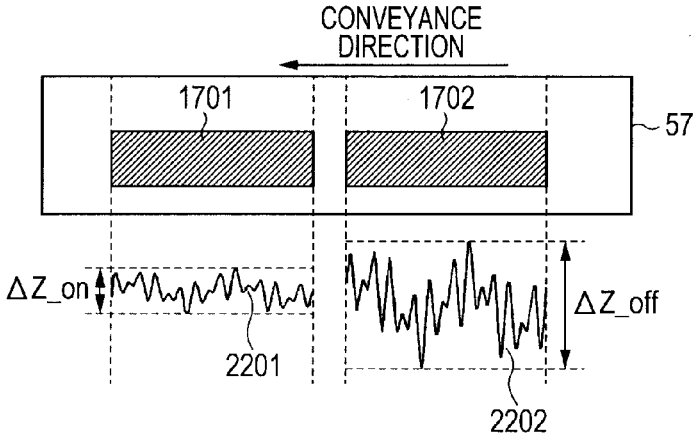
FIG. 14B is banding detection results for the test patch C.

FIG. 14B illustrates example density detection results 2201 and 2202 for the test patches 1701 and 1702, respectively. The CPU 21 calculates a difference ΔZ_on between a maximum density and a minimum density of the test patch 1701 from the density detection results (S1603). The CPU 21 also calculates a difference ΔZ_off between a maximum density and a minimum density of the test patch 1702 (S1603).

The CPU 21 compares the calculated differences ΔZ_on and ΔZ_off each other in magnitude (S1604). In the determination of the relationship in magnitude in S1604, if the CPU 21 has determined that the difference ΔZ_on is smaller than the difference ΔZ_off, that is, if the banding correction is in a good condition, the banding correction flag is set to "ON" (S1605). Subsequently, the CPU 21 compares a ratio ΔZ_on/ΔZ_off of the difference ΔZ_on relative to the difference ΔZ_off and a threshold value Th1 with each other (S1606). If the CPU 21 has determined that the value of ΔZ_on/ΔZ_off is smaller than the threshold value Th1, the CPU 21 terminates the processing for determining the necessity or non-necessity for exposure output correction table re-creation processing. If the CPU 21 has determined that the value of ΔZ_on/ΔZ_off is not smaller than the threshold value Th1, the CPU 21 determines that the effect of the banding correction is small, and sets a pre-scheduled flag to "ON" (S1607), and then terminates the processing for determining the necessity or non-necessity for exposure output correction table re-creation processing.

Meanwhile, if the CPU 21 has determined in S1604 that the difference ΔZ_on has a value that is not smaller than the difference ΔZ_off, that is, if the banding correction is not in a good condition, the CPU 21 sets the banding correction flag to "OFF" in S1608. Subsequently, in S1609, the CPU 21 compares the difference ΔZ_off and a threshold value Th2 with each other to determine a timing for performing density correction. If the difference ΔZ_off is smaller the threshold value Th2, the CPU 21 sets the pre-scheduled flag to "ON" in S1610. Here, the CPU 21 continues printing as it is with the density correction flag set to "OFF" in S1608. Meanwhile, in S1609, if the difference ΔZ_off is not smaller than the threshold value Th2, the CPU 21 determines that the intensity of the banding falls out of a tolerable range and sets a forcible execution flag to "ON" in S1611. The CPU 21 setting the forcible execution flag to "ON" in S1611 means that the intensity of the banding falls out of a tolerable range regardless of whether the density correction in S1207 has been performed or not, and thus, means that the image quality has substantially deteriorated. A case where the difference ΔZ_on is larger than the difference ΔZ_off and the difference Δ_off is larger than the threshold value Th2 means that the intensity of the banding is not suppressed at a first level or higher. Also, a case where the difference ΔZ_on is larger than the difference ΔZ_off and the difference ΔZ_off is smaller than the threshold value Th2 means that the intensity of the banding is suppressed at a first level or higher but is not suppressed at a second level or higher. In other words, when the density correction in S1207 has been performed, the state in which the image quality has substantially deteriorated can be improved to secure a certain level of image quality if the density correction is canceled. Also, a case where the difference ΔZ_on is smaller than the difference ΔZ_off and the value of ΔZ_on/ΔZ_off is smaller than the threshold value Th1 also means that the intensity of the banding is suppressed at the second level or higher, which is larger than the first level in terms of the degree of banding suppression. As described above, the densities of the patch formed between printed images is measured, and whether or not to perform banding correction processing and the timing for performing the banding correction are determined from the results of the determination, enabling suppression of an adverse increase in banding occurring as a result of erroneous correction of banding.

For each of the test patch 1701 and 1702, the difference Z_on and the difference ΔZ_off are calculated from the difference between the maximum density and the minimum density. However, the calculation method is not limited to such one. Instead of the differences Z_on and ΔZ_off, whether or not to perform banding correction may be determined by comparing the standard deviations of the density detection results in terms of the magnitude. Furthermore, although in the present embodiment, the test patch C is formed between printed images, the test patch C may be formed between print jobs or after the elapse of a predetermined period of time.

Figure 16A:
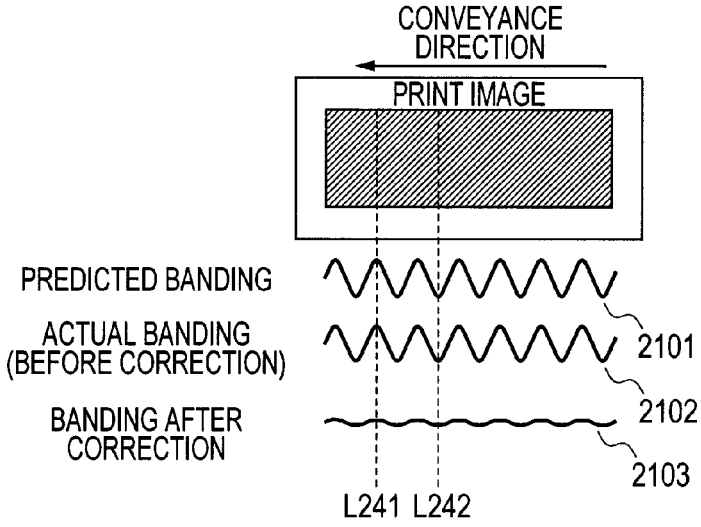
FIGS. 16A and 16B illustrating a relationship between predicted banding and actual banding according to a conventional example.
Figure 16B:
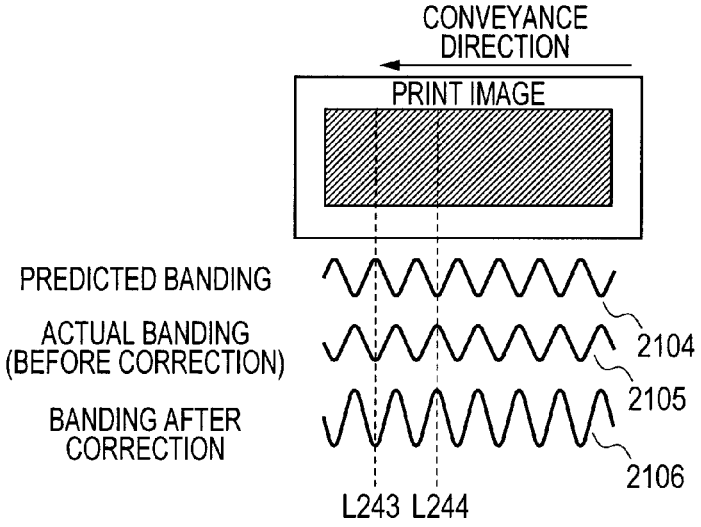

In the flowchart in FIG. 13, a certain effect can be provided even where S1606, S1607 and S1609 to S1611 are omitted. In other words, if the CPU 21 has made determination of "YES" in S1604, it can be considered that the banding correction exerts a certain effect. In such case, the CPU 21 sets the banding correction flag to "ON". Also, if the CPU 21 has made determination of "NO" in S1604, it can be considered that the banding correction exerts no effect. Accordingly, in such case, the CPU 21 sets the banding correction flag to "OFF". The above-described operation enables prevention of banding correction that increases the banding when the phase of predicted banding and the phase of actual banding are different from each other, which has been described with reference to FIGS. 16A and 16B.

[Processing After Start of Printing]

Figure 15:
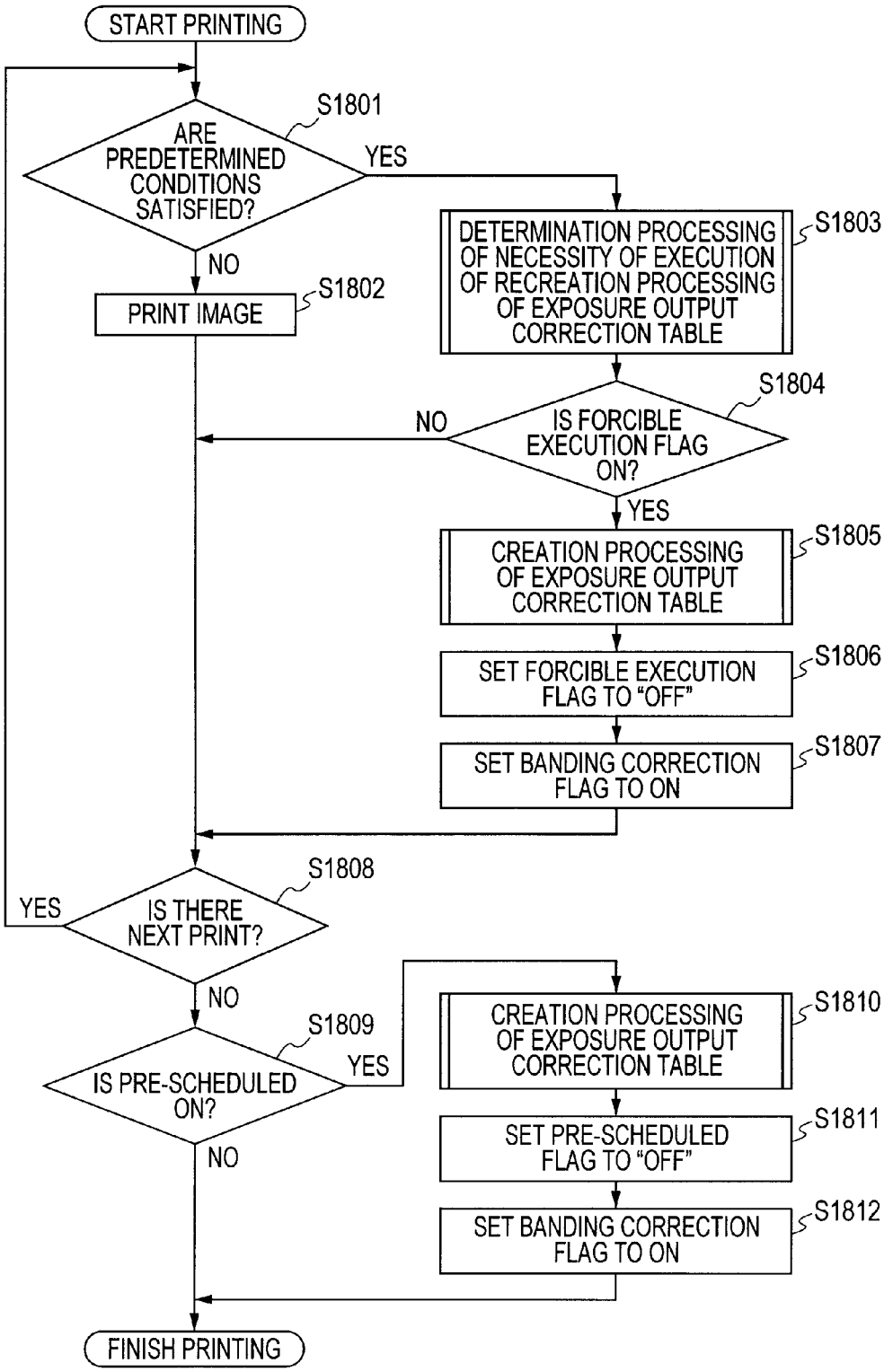
FIG. 15 is a flowchart illustrating a print operation according to the embodiment.

A flow of processing after the start of printing will be described with reference to FIG. 15. Upon start of printing, the image forming unit 60 prints a print image whose densities have been corrected. Subsequently, in S1801, the CPU 21 determines whether or not predetermined conditions, including whether or not a predetermined number of sheets have been printed from a point of time when the last density correction was ended, whether or not a predetermined period of printing time has elapsed or whether or not there is a temperature change exceeding a threshold value, have been satisfied.

Then, if the CPU 21 has determined in S1801 that the predetermined conditions have been satisfied, in S1803, the CPU 21 starts the processing for determining the necessity or non-necessity for exposure output correction table re-creation processing (FIG. 13). If the CPU 21 has determined in S1801 that the predetermined conditions have not been satisfied, in S1802, the CPU 21 makes the image forming unit 60 perform printing of the print image.

After the end of the processing for determining the necessity or non-necessity for exposure output correction table re-creation processing in S1804, the CPU 21 determines whether or not the forcible execution flag is "ON". Then, if the CPU 21 has determined that the forcible execution flag is "ON", the CPU 21 performs the exposure output correction table creation processing (FIG. 6) in S1805. The processing in S1805 enables reset of the relationship between the phases of the motor as a rotary member and the correction information (banding correction information). Furthermore, there is a certain relationship between the phases of the motor as a rotary member and phases of banding that actually occurs or may occur. Accordingly, it can also be considered that the processing in S1805 enables re-set of the relationship between the phases of banding that actually occurs or may occur and correction information. Subsequent to S1805, the CPU 21 makes the setting to set the forcible execution flag to "OFF" in S1806. Also, the CPU 21 sets the banding correction flag to "ON" in S1807.

If the CPU 21 has determined in S1804 that the forcible execution flag is "OFF", the CPU 21 advances the processing to S1808. In S1808, the CPU 21 determines whether or not there is a next print image, and if there is a print image to be printed, the CPU 21 returns the processing to S1801 and performs the processing in S1801 onwards with the next print image as a target. If the CPU 21 has determined in S1808 that there is no print image to be printed, the CPU 21 determines in S1809 whether or not the pre-scheduled flag is "ON". If the CPU 21 has determined in S1809 that the pre-scheduled flag is "ON", the CPU 21 performs the exposure output correction table creation processing (FIG. 6) in S1810, and then sets the pre-scheduled flag to "OFF" in S1811. In S1812, the CPU 21 sets the banding correction flag to "ON" and then terminates the printing. If the CPU 21 has determined in S1809 whether or not the pre-scheduled flag is "OFF", then the CPU 21 terminates the printing. During the power supply being on, the forcible execution flag and the pre-scheduled flag are set to be "OFF". According to the above-described processing, when the forcible execution flag is "ON", even if there is a print image to be printed, printing of the print image is temporarily halted, and the exposure output correction table creation processing is performed. Also, when the pre-scheduled flag is "ON", the exposure output correction table creation processing is performed when there is no longer print image to be printed next. Consequently, both ensuring of usability and image quality enhancement can be provided.

[Variations]

Position for Forming a Test Patch

The above description has been given in terms of an example in which a patch is formed on the intermediate transfer member 57. However, a patch may be formed on a transfer material conveyance belt (transfer material carrier). In other words, the above-described embodiment is applicable to an image forming apparatus employing a primary transfer method in which a toner image developed by a photosensitive drum 22 is directly transferred to a transfer material 11. In such case, the intermediate transfer member 57, on which a patch is to be formed in the above-described embodiment, may be replaced with a transfer material conveyance belt. A patch may also be formed on a surface of the photosensitive drum 22. In such case, the intermediate transfer member 57, on which a patch is to be formed in the above-described embodiment, may be replaced with the surface of the photosensitive drum 22.

[Applicable Type of Rotary Members]

Although the above description has been provided using a motor 6 for driving a photosensitive drum 22 as an example of a rotary member for forming an image based on externally-input image data, the above description may also be applied to a rotary member for image formation, other than the motor 6.

Examples of the rotary member include a photosensitive drum 22 itself, a motor for rotating a development sleeve and the motor 6*e* for rotating the drive roller 72. Then, for rotation unevenness of each of such rotary members, processing similar to the above-described density correction performed for the W1 and W4 components may be performed to correct banding resulting from the rotation unevenness of the rotary member. The above description may also be applied to, e.g., a motor for driving the transfer material conveyance belt. With reference to FIGS. 8A to 8C, if, for example, a photoreceptor 22 is employed for a rotary member for image formation, θ1 and θ2 illustrated in FIGS. 8A and 8B may be replaced with rotation unevenness phases of the photoreceptor 22. Then, processing similar to the above may be performed for the rotation unevenness phases of the photoreceptor 22. The case of the photoreceptor 22 can be applied in a similar manner to any other rotary member for image formation.

[Rotation Unevenness Phases Related to Banding]

The above description has been provided in terms of a case where a motor phase during exposure and banding correction information are related to each other and stored in the memory section 50. However, a motor phase during transfer, which can be predicted at the time of exposure, or a motor phase at an arbitrary timing after exposure and before transfer, which can be predicted at the time of exposure, and banding correction information may be related to each other.

[Formation of Tables and Arithmetic Expressions]

Although FIGS. 9A to 9C indicate that phase information for the motor 6 and banding correction information are held in an exposure output correction table, the storage method is not limited to this example. For example, an arithmetic operation in which phase information for the motor 6 is an input and banding correction information can be output may be obtained and stored in the memory section 50.

[Correction Method]

In the above embodiment, banding correction using a density property opposite to banding correction resulting from rotation unevenness of the motor 6 is performed so as to cancel the banding. For example, if the density is high in the banding, the image forming unit 60 performs correction to lower the density. However, density correction performed by the image forming unit 60 is not limited to the embodiment.

In order to cancel deviation of scanning line from ideal positions thereof due to banding, a centroid position of an image for each scanning line may be corrected by means of density correction to perform simulated correction of the scanning line positions. In this case, first, the banding of each of the aforementioned W1 and W4 components is detected by the density sensor 71. Here, there is the relationship between the phases of the banding and the phases of rotation unevenness of the motor 6 as described above. Then, the CPU 21 calculates the pitches of the scanning lines depending on the magnitude of the densities, using a conversion table. In other words, the relationship between the pitches of the scanning lines and the phases of the rotation unevenness of the motor 6 can be obtained. Then, for simulated correction of uneven pitches to ideal pitches, the centroids of the images are corrected by means of changing the densities of the respective scanning lines.

Although the above description has been provided in terms of an example in which banding is reduced by controlling exposure performed by a scanner 24, the method is not limited to the example. For example, if a charging bias of a charger 23 or a developing bias of a developing device 56 has sufficiently good responsiveness, the charging bias or the developing bias may be controlled so as to exert an effect similar to the effect of the abovementioned exposure control. By means of controlling various image forming conditions, an effect similar to the effect of the abovementioned exposure control can be obtained.

[Other Examples of Test Patches]

FIGS. 14A and 14B illustrates an example in which the test patch 1701 subjected to banding correction and the test patch 1702 not subjected to banding correction are formed between print images. The effects of the present invention can also be obtained if these test patches are changed as follows.

(I) Where Only Test Patches Not Subjected to Banding Correction are Formed

Test patches 1702 not subjected to banding correction may be formed. In this case, if the banding of each of the test patches not subjected to banding correction is not larger than a certain threshold value, banding correction is cancelled. In other words, the banding having a value that is not larger than the threshold value means that image quality enhancement can be expected more if no correction is performed. In such a manner as described above, more effective banding correction can also be performed.

(II) Where Only Patches Subjected to Banding Correction are Formed

Test patches 1701 subjected to banding correction may also be formed. In this case, if the banding of each of the test patches subjected to banding correction is not smaller than a certain threshold value, banding correction is cancelled, or the exposure output correction table for the banding correction is re-set, enabling performance of more effective banding correction.

(C) Where Test Patches are Formed Using Different Exposure Output Correction Tables In this case, a plurality of exposure output correction tables exhibiting different relationships between rotation phases of an attention rotary member and correction information (banding correction information) are stored in advance in the memory section 50. For example, two types of exposure output correction tables, i.e., the exposure output correction table illustrated in FIG. 9C and an exposure output correction table exhibiting a relationship between correction information and phases, which has been shifted by 180 degrees from that in the exposure output correction table illustrated in FIG. 9C, are stored in advance in the memory section 50. Then, in S1601 in FIG. 13, two types of test patches (a first inspection image and a second inspection image) are formed using the respective exposure output correction tables and densities of the test patches are inspected by the density sensor 71 in S1602. If banding intensity (density variation) having a value that is not smaller than a predetermined threshold value has been detected for both of the test patches, no banding correction is performed. Meanwhile, if banding intensity of any of the test patches is smaller than the threshold value, a setting is made so as to employ a most favorable density correction table (relationship between phases of a rotary member and banding correction information) afterward. Consequently, most effective banding correction can be performed. Furthermore, the above-described processing may be performed using a further increased number of exposure output correction tables (relationships between banding correction information and phases).

As described above, the present embodiment enables an increase in banding resulting from a difference between predicted banding and actual banding to be avoided in banding correction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-130286, filed Jun. 7, 2010, which is hereby incorporated by reference herein in its entirety.

What is claimed is:

1. An apparatus for controlling formation of an image by an image forming unit having a rotary member for image formation based on image data that is externally input, the apparatus comprising:

a correction section that performs banding correction for banding periodically occurring in a sub-scanning direction, by correcting the image data based on banding correction information according to a phase of the rotary member;

a control section that performs control to make the image forming unit form an inspection image for determining whether or not the intensity of the banding periodically occurring in the sub-scanning direction is suppressed to be smaller than a predetermined threshold value, for an image formed by the image forming unit; and a detection section that detects the intensity of the periodic banding in the sub-scanning direction of the inspection image formed by the image forming unit, wherein the inspection image includes a first inspection image in which the banding correction is performed and a second inspection image in which the banding correction is not performed, and wherein in a case where the intensity of the banding for the first inspection image detected by the detection section is larger than the intensity of the banding for the second inspection image detected by the detection section, the control section does not perform a banding correction for subsequent image formation, or performs control to re-set the relationship between the phase of the banding and the banding correction information for correcting the image data.

2. An apparatus according to claim 1, wherein in a case where the intensity of the banding detected by the detection section in the second inspection image is not larger than a predetermined threshold value, the control section is controlled so as not to perform the banding correction for subsequent image formation.

3. An apparatus according to claim 1, wherein in a case where the intensity of the banding for the first inspection image detected by the detection section is not smaller than a predetermined threshold value, the control section is controlled so as not to perform the banding correction for subsequent image formation, or performs control to re-set the relationship between the phase of the banding and the banding correction information.

4. An apparatus according to claim 1, wherein the inspection image includes a first inspection image and a second inspection image in which the banding correction is performed based on different relationships between the phase of the rotary member and the banding correction information; and wherein based on the intensity of the banding for the first inspection image detected by the detection section, and the intensity of the banding for the second inspection image detected by the detection section, the control section controls the apparatus so as not to perform the banding correction for subsequent image formation or performs control to re-set the relationship between the phase of the banding and the banding correction information.

5. An apparatus according to claim 1, wherein when the result of the detection performed by the detection section for the inspection image is a case where the intensity of the banding is at a level equal to or more than a first level, the control section stops a print job, and re-sets the relationship between the phase of the rotary member and the banding correction information in the banding correction; and wherein in a case where the intensity of the banding detected by the detection section is not at the level that is equal to or more than the first level, and is at a level that is not equal to or more than a second level larger in suppression degree than the first level, the control section performs control to re-set the relationship between the phase of the rotary member and the banding correction information in the banding correction after end of the print job.

6. An apparatus according to claim 1, wherein the inspection image is formed at a position between printed images or transfer materials, after a power supply for an apparatus main body is turned on and before the image formation based on externally-input image data is performed.

7. An apparatus according to claim 1, comprising:

a phase determining section that determines a phase of a periodic rotation speed variation of a motor based on a signal that is output at least one time per a rotation of the motor; and a coordinate section that coordinates a phase of the periodic rotation speed variation when a test patch is formed, so as to correspond to each position along a moving direction of the test patch for a banding correction formed by the image forming unit, wherein the control section generates correction information for correcting the density according to the phase of the periodic rotation speed variation, based on a coordination by the coordinate section and a detection result of the test patch detected by the detection section, and wherein the control section performs the banding correction based on the detection result.

8. An apparatus for controlling image formation by an image forming unit having a rotary member for image formation based on image data that is externally input, the apparatus comprising:

a correction section that performs banding correction for banding periodically occurring in a sub-scanning direction, by correcting the image data based on banding correction information according to a phase of the rotary member;

a control section that performs control to make the image forming unit form an inspection image for determining whether or not the intensity of the banding periodically occurring in the sub-scanning direction is suppressed to be smaller than a predetermined threshold value, for an image formed by the image forming unit; and a detection section that detects the intensity of the periodic banding in the sub-scanning direction of the inspection image formed by the image forming unit, wherein if based on the intensity of the banding detected by the detection section, the control section has determined that the banding is not suppressed to be smaller than the predetermined threshold value, the control section performs control to not perform the banding correction or performs control to re-set a relationship between the phase of the rotary member and the banding correction information for correcting the image data, wherein when the result of the detection performed by the detection section for the inspection image is a case where the intensity of the banding is at a level equal to or more than a first level, the control section stops a print job, and re-sets the relationship between the phase of the rotary member and the banding correction information in the banding correction, and wherein in a case where the intensity of the banding detected by the detection section is not at a level that is equal to or more than the first level, and is at a level that is not equal to or more than a second level larger in suppression degree than the first level, the control section performs control to re-set the relationship between the phase of the rotary member and the banding correction information in the banding correction after the end of the print job.

* * * * *